US011754306B2

(12) United States Patent
Gillette et al.

(10) Patent No.: US 11,754,306 B2
(45) Date of Patent: Sep. 12, 2023

(54) HVAC ZONE CONTROL PANEL ELECTRONIC DISPLAY SYSTEMS AND METHODS

(71) Applicant: Johnson Controls Technology Company, Auburn Hills, MI (US)

(72) Inventors: Theresa N. Gillette, Wichita, KS (US); Tyler P. McCune, El Dorado, KS (US); Jonathan A. Burns, Wichita, KS (US)

(73) Assignee: JOHNSON CONTROLS TYCO IP HOLDINGS LLP, Milwaukee, WI (US)

( * ) Notice: Subject to any disclaimer, the term of this patent is extended or adjusted under 35 U.S.C. 154(b) by 831 days.

(21) Appl. No.: 15/991,970

(22) Filed: May 29, 2018

(65) Prior Publication Data

US 2019/0353380 A1 Nov. 21, 2019

Related U.S. Application Data

(60) Provisional application No. 62/671,811, filed on May 15, 2018.

(51) Int. Cl.
*F24F 11/65* (2018.01)
*F24F 11/49* (2018.01)
(Continued)

(52) U.S. Cl.
CPC ..... *F24F 11/523* (2018.01); *F24F 11/49* (2018.01); *F24F 11/54* (2018.01); *F24F 11/65* (2018.01); *F24F 11/80* (2018.01); *F24F 2110/10* (2018.01)

(58) Field of Classification Search
CPC ..... F24F 11/523; F24F 11/65; F24F 11/49; F24F 11/80; F24F 11/54; F24F 2110/10; F24F 11/30; F24F 11/52
See application file for complete search history.

(56) References Cited

U.S. PATENT DOCUMENTS 7,212,887 B2 5/2007 Shah et al.
7,558,648 B2 7/2009 Hoglund et al.
(Continued)

FOREIGN PATENT DOCUMENTS

CA 2957726 A1 3/2016
CA 3043996 A1 2/2018
(Continued)

OTHER PUBLICATIONS

CoolingLogic, "CoolingLogic: Up early, saving billions." URL: http://coolinglogic.com/documents/MarketingFlyer_FINAL_HiRes8.5×11.pdf, retrieved from internet Oct. 27, 2022 (1 page).
(Continued)

*Primary Examiner* — Darrin D Dunn
(74) *Attorney, Agent, or Firm* — Fletcher Yoder, PC

(57) ABSTRACT

The present disclosure includes a heating, ventilation, and air conditioning (HVAC) system having a zone control panel suitable to control operation of equipment and/or devices in the HVAC system. The zone control panel may include an electronic display to facilitate user interaction with the HVAC system. For example, the electronic display may be used to view, configure, and/or modify operation of the zone control panel and/or other devices implemented in the HVAC system. Further, the zone control panel may use the electronic display to reproduce user interfaces from the equipment and/or the devices. As such, the zone control panel may centralize presentation of relevant information and/or present the relevant information in a familiar manner.

20 Claims, 14 Drawing Sheets

(51) Int. Cl.

| | |
|---|---|
| ***F24F 11/80*** | (2018.01) |
| ***F24F 11/54*** | (2018.01) |
| ***F24F 11/523*** | (2018.01) |
| *F24F 110/10* | (2018.01) |

(56) References Cited

U.S. PATENT DOCUMENTS

| | | | | |
|---|---|---|---|---|
| 7,693,583 | B2 | 4/2010 | Wolff et al. | |
| 7,693,591 | B2 | 4/2010 | Hoglund et al. | |
| 7,913,180 | B2 | 3/2011 | Hoglund et al. | |
| 9,002,525 | B2 | 4/2015 | Gourlay et al. | |
| 9,447,985 | B2 | 9/2016 | Johnson | |
| 9,651,925 | B2 | 5/2017 | Filbeck et al. | |
| 10,871,756 | B2 | 12/2020 | Johnson et al. | |
| 10,908,578 | B2 | 2/2021 | Johnson et al. | |
| 10,921,768 | B2 | 2/2021 | Johnson et al. | |
| 11,156,978 | B2 | 10/2021 | Johnson et al. | |
| 2005/0040248 | A1* | 2/2005 | Wacker | G05D 23/1905 236/51 |
| 2010/0292864 | A1 | 11/2010 | Sung et al. | |
| 2013/0087628 | A1* | 4/2013 | Nelson | F24F 11/30 236/51 |
| 2014/0058569 | A1* | 2/2014 | Kuroiwa | F24F 11/30 700/276 |
| 2014/0202188 | A1 | 7/2014 | Hrejsa et al. | |
| 2014/0207291 | A1* | 7/2014 | Golden | F24F 11/30 700/277 |
| 2015/0268652 | A1* | 9/2015 | Lunacek | F24F 11/30 700/276 |
| 2015/0323207 | A1 | 11/2015 | Son et al. | |
| 2016/0054027 | A1* | 2/2016 | Dyess | F24F 11/30 700/277 |
| 2016/0209062 | A1 | 7/2016 | Castillo et al. | |
| 2016/0231013 | A1* | 8/2016 | Kates | F24F 11/30 |
| 2019/0107296 | A1* | 4/2019 | Clark | F24F 11/56 |

FOREIGN PATENT DOCUMENTS

| | | | |
|---|---|---|---|
| EP | 1674804 | B1 | 12/2009 |
| EP | 1342960 | B1 | 4/2012 |
| EP | 3 186 687 | A4 | 7/2017 |
| EP | 3 497 377 | A1 | 6/2019 |

OTHER PUBLICATIONS

Incomplete File of Communication with Various Companies, etc. in 2016-2021, URL: http://coolinglogic.com/documents/22072101_Letters_and_Signature_Receipts.pdf, published, as one document, on: Jul. 21, 2022 (211 pages).

Johnson Heating and Cooling L.L.C., "Divine Grace Building Automation (Images)," URL: http://cooljohnson.com/Building-Automation-Systems-Michigan/Oakland-County-Michigan/Building-Automation-Images.html, retrieved from internet Oct. 27, 2022 (8 pages).

Johnson Heating and Cooling L.L.C., "Divine Grace Building Automation," URL: http://cooljohnson.com/Building-Automation-Systems-Michigan/Oakland-County-Michigan/Building-Automation-Divine-Grace.html, retrieved from internet Oct. 27, 2022 (3 pages).

Johnson Heating and Cooling L.L.C., "Excel Rehabilitation Building Automation," URL: http://cooljohnson.com/Building-Automation-Systems-Michigan/Waterford-Michigan/Building-Automation-System--Excel.html, retrieved from internet Oct. 27, 2022 (2 pages).

Johnson Heating and Cooling L.L.C., "Intertek Testing Services Building Automation," URL: http://cooljohnson.com/Building-Automation-Systems-Michigan/Plymouth-Michigan/Building-Automation-System-Plymouth-Michigan.html, retrieved from internet Oct. 27, 2022 (8 pages).

Johnson Heating and Cooling L.L.C., "JLA Medical Building Building Automation," URL: http://cooljohnson.com/Building-Automation-Systems-Michigan/Waterford-Michigan/Building-Automation-System--JLA.html, retrieved from internet Oct. 27, 2022 (3 pages).

Johnson Heating and Cooling L.L.C., "Mosaic Christian Building Automation (Images)," URL: http://cooljohnson.com/Building-Automation-Systems-Michigan/Detroit/Building-Automation-Images.html, retrieved from internet Oct. 27, 2022 (12 pages).

Johnson Heating and Cooling L.L.C., "Mosaic Christian Building Automation," URL: http://cooljohnson.com/Building-Automation-Systems-Michigan/Detroit/Mosaic-Christian.html, retrieved from internet Oct. 27, 2022 (5 pages).

Johnson Heating and Cooling L.L.C., "Shepherd's Gate Lutheran Church Building Automation," URL: http://cooljohnson.com/Building-Automation-Systems-Michigan/Shelby-Township-Michigan/Building-Automation-Systems-SG.html, retrieved from internet Oct. 27, 2022 (3 pages).

Johnson Heating and Cooling L.L.C., "St. Clair County Residence Building Automation," URL: http://cooljohnson.com/Building-Automation-Systems-Michigan/St-Clair-Michigan/Building-Automation-System-St-Clair-Michigan.html, retrieved from internet Oct. 27, 2022 (4 pages).

Johnson Heating and Cooling L.L.C., "St. Joseph Mercy Oakland U. C. Building Automation," URL: http://cooljohnson.com/Building-Automation-Systems-Michigan/Waterford-Michigan/Building-Automation-Systems-SJMO.html, retrieved from internet Oct. 27, 2022 (2 pages).

Johnson Heating and Cooling L.L.C., "Waterford Internal Medicine Building Automation," URL: http://cooljohnson.com/Building-Automation-Systems-Michigan/Waterford-Michigan/Building-Automation-Systems-WIM.html, retrieved from internet Oct. 27, 2022 (3 pages).

Johnson Heating and Cooling, LLC, "Building Automation Clawson Michigan 2.0," URL: http://cooljohnson.com/Building-Automation-Systems-Michigan/Clawson-Michigan/Building-Automation-Clawson-Manor-2.html, retrieved from the internet Oct. 27, 2022 (6 pages).

Johnson Heating and Cooling, LLC, "Building Automation Images Clawson Michigan 2.0," URL: http://cooljohnson.com/Building-Automation-Systems-Michigan/Clawson-Michigan/Building-Automation-Clawson-Manor-2-Images.html, retrieved from the internet Oct. 27, 2022 (14 pages).

Johnson Heating and Cooling, LLC, "Building Automation System Clawson Michigan Clawson Manor," URL: http://cooljohnson.com/Building-Automation-Systems-Michigan/Clawson-Michigan/Building-Automation-System-Clawson-Manor.html; retrieved from the internet Oct. 27, 2022 (3 pages).

Johnson Heating and Cooling, LLC, "Building Automation System in Michigan Images," URL: http://cooljohnson.com/Building-Automation-Systems-Michigan/Macomb-County-Michigan/Building-Automation-Images.html; retrieved from the internet Oct. 27, 2022 (13 pages).

Johnson Heating and Cooling, LLC, "Building Automation System in Michigan," URL: http://cooljohnson.com/Building-Automation-Systems-Michigan/Macomb-County-Michigan/Building-Automation-Confidential-Customer.html; retrieved from the internet, Oct. 27, 2022 (4 pages).

Johnson Solid State LLC, "Building Automation Equipment," URL: http://cooljohnson.com/Video/Building_Automation/Confidential_Customer_BLD_2/Building_Automation_Equipment.mp4, retrieved from internet Oct. 27, 2022 (35 pages).

Johnson Solid State LLC, "Building Automation GUI," URL: http://cooljohnson.com/Video/Building_Automation/Confidential_Customer_BLD_2/Building_Automation_GUI.mp4, retrieved from internet Oct. 27, 2022 (24 pages).

Johnson Solid State LLC, "Cooling Logic Overview," URL: http://coolinglogic.com/documents/CoolingLogic_Overview_High_Quality.mp4, retrieved from internet Oct. 27, 2022 (16 pages).

Johnson Solid State LLC, "So what is CoolingLogic™?" URL: http://coolinglogic.com/Coolinglogic-How-it-Works.html, retrieved from the internet Oct. 27, 2022 (3 pages).

Johnson, David, "A Method to Increase HVAC System Efficiency And Decrease Energy Consumption," White Paper: Johnson Solid State, LLC, URL: http://coolinglogic.com/documents/16102106_White_Paper_High_Resolution_Protected.pdf, Sep. 24, 2016 (51 pages).

Johnson, David, "CoolingLogic™: Mosaic Christian Church A Case Study," Report: Johnson Solid State, LLC, URL: http://coolinglogic.

(56) References Cited

OTHER PUBLICATIONS com/documents/19020301_Mosaic_Christian_Coolinglogic_Case_Study.pdf, Feb. 2, 2019 (140 pages).
Johnson, David, "Excel Rehabilitation Building Automation: Building Automation System User Manual ," URL: http://cooljohnson.com/Building-Automation-Systems-Michigan/Waterford-Michigan/Building-Automation-System-Excel-Manual.html, 2012 (10 pages).
Johnson, David, "Temperature Control System and Methods for Operating Same," Pre-Publication printout of U.S. Appl. No. 15/231,943, filed Aug. 9, 2016, URL: http://coolinglogic.com/documents/16080901_CIP_As_Filed.pdf (99 pages).
Johnson, David., "CoolingLogic™: Changing the Way You Cool," Report: Johnson Solid State, LLC, URL: http://coolinglogic.com/documents/18111303_Changing_the_way_you_Cool.pdf, Nov. 7, 2018 (12 pages).

* cited by examiner

HVAC ZONE CONTROL PANEL ELECTRONIC DISPLAY SYSTEMS AND METHODS

This application is a Non-Provisional Patent Application of U.S. Provisional Patent Application No. 62/671,811, entitled "HVAC Zone Control Panel Electronics Display Systems and Methods", filed May 15, 2018, which is herein incorporated in its entirety for all purposes.

BACKGROUND

The present disclosure generally relates to heating, ventilation, and air conditioning (HVAC) systems and, more particularly, to a zone control board or panel that may be implemented in a HVAC system.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

An HVAC system generally includes a control system to control and/or to coordinate operation of devices, such as equipment, machines, and sensors. For example, the control system may communicate sensor data and/or control commands with devices in the HVAC system. The control system may include a control board or panel implemented with a user interface, such as an electronic display and/or a button. For example, based on operational parameters received from HVAC equipment, the control panel may display a visual representation of the operational parameters on its electronic display. However, as the number of devices implemented in an HVAC system increases, presentation of information, such as operational parameters, may become increasingly cumbersome, for example, due to devices implemented in the HVAC system being produced by different manufacturers.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, an HVAC system includes first equipment that facilitates supplying temperature controlled air to an internal space within a building serviced by the HVAC system, where the first equipment comprises a first interface that indicates first operational parameters of the first equipment. The HVAC system further includes a zone control panel communicatively coupled to the first equipment and programmed to control operation of first equipment. The zone control panel comprises a first electronic display and a microcontroller communicatively coupled to the first electronic display. The microcontroller is programmed to determine a first device targeted by a user based at least in part on a first user input received by the zone control panel. Further, the microcontroller is programmed to, when the first device targeted by the user is the first equipment, determine first data indicative of the first operational parameters of the first equipment. The microcontroller is further programmed to, when the first device targeted by the user is the first equipment, instruct the first electronic display to reproduce the first interface by displaying a first graphical user interface based at least in part on the first data indicative of the first operational parameters of the first equipment.

In another embodiment, a method to display information in an HVAC system on an electronic display of a zone control panel involves determining, using at least one processor of the zone control panel, a first device targeted by a user based at least in part on a first user input received by the zone control panel. The method further involves, when the first device targeted by the user is first equipment in the HVAC system communicatively coupled to the zone control panel, where the first equipment facilitates supplying temperature controlled air to an internal space within a building serviced by the HVAC system and includes a first interface configured to indicate first operational parameters of the first equipment, determining, using the at least one processor, first data indicative of the first operational parameters of the first equipment. Further, when the first device targeted by the user is first equipment in the HVAC system communicatively coupled to the zone control panel, the method involves instructing, using the at least one processor, the electronic display to reproduce the first interface by displaying a first graphical user interface based at least in part on the first data indicative of the first operational parameters of the first equipment.

In another embodiment, a tangible, non-transitory, machine-readable medium, comprising machine-readable instructions executable by at least one processor of a zone control panel in an HVAC system that, when executed by the at least one processor, cause the at least one processor to determine a first device targeted by a user based at least in part on a first user input received by the zone control panel. The instructions, when executed, further cause the at least one processor to, when the first device targeted by the user is equipment in the HVAC system communicatively coupled to the zone control panel, where the equipment facilitates supplying temperature controlled air to an internal space within a building serviced by the HVAC system and includes a first interface configured to indicate operational parameters of the equipment, determine first data indicative of the operational parameters of the equipment. Further, when the first device targeted by the user is equipment in the HVAC system communicatively coupled to the zone control panel, the instructions, when executed, cause the at least one processor to instruct an electronic display of the zone control panel to reproduce the first interface by displaying a graphical user interface based at least in part on the first data indicative of the operational parameters of the equipment.

BRIEF DESCRIPTION OF THE DRAWINGS

Various aspects of the present disclosure may be better understood upon reading the following detailed description and upon reference to the drawings, in which.

DETAILED DESCRIPTION

Figure 1:
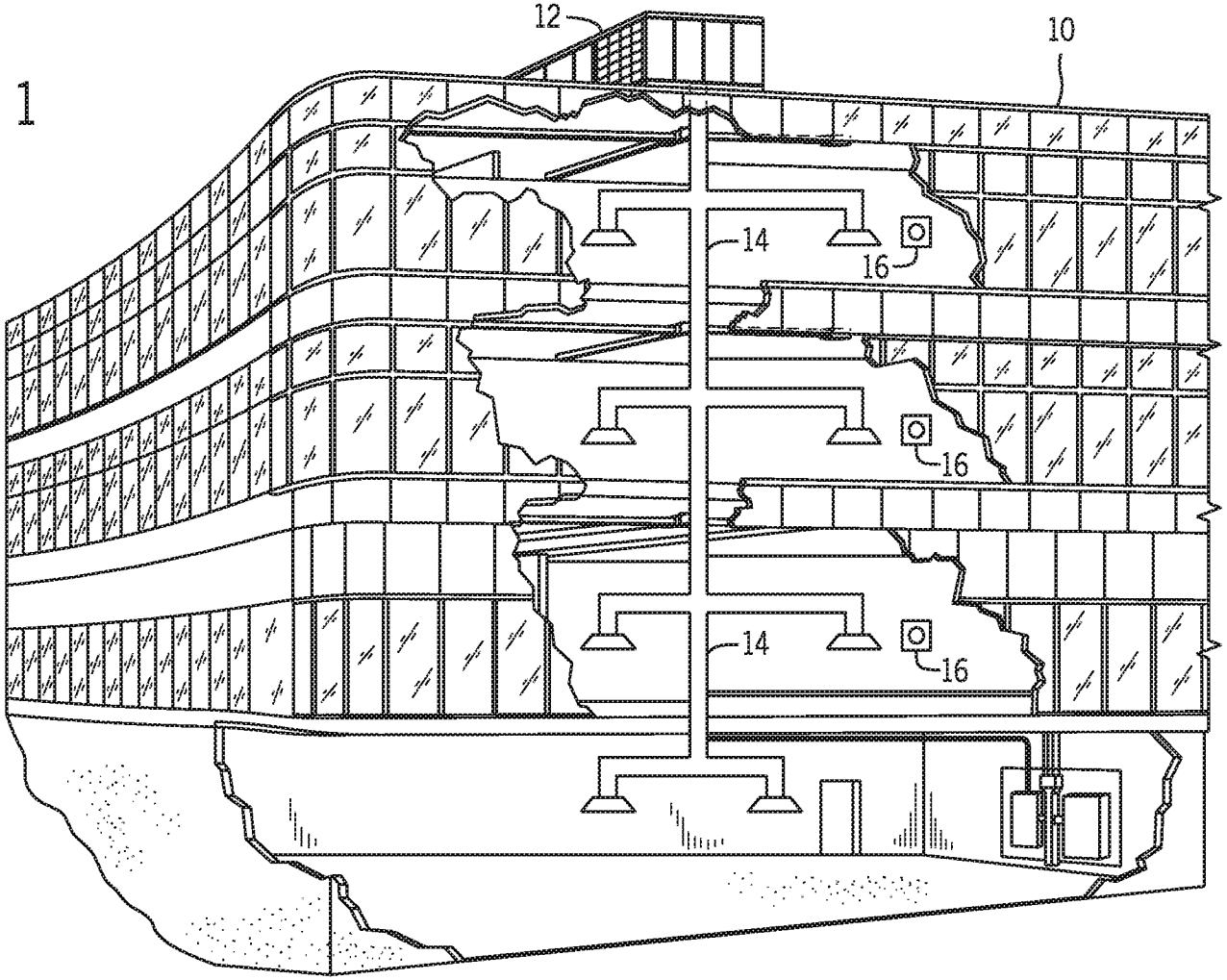
FIG. 1 illustrates a heating, ventilating, and air conditioning (HVAC) system for building environmental management that may employ one or more HVAC units, in accordance with an embodiment of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but may nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As will be discussed in further detail below, heating, ventilation, and air conditioning (HVAC) systems often utilize a control system to control the operation of devices or equipment within the HVAC system, for example, implemented via one or more zone control boards or panels. That is, a zone control panel may receive input data or signals from one or more devices in the HVAC system, such as an interface device, a thermostat, a sensor, another zone control panel, or any combination thereof. Additionally or alternatively, a zone control panel may output control commands or signals that instruct one or more other devices in the HVAC system to perform control actions. For example, a zone control panel may receive a temperature setpoint via a thermostat, compare the temperature setpoint to a temperature measurement received from a sensor, and instruct equipment in the HVAC system to adjust operation when the temperature measurement deviates from the temperature setpoint by more than a threshold amount.

The zone control panel may include an electronic display to facilitate user interaction with the HVAC system, for example, by displaying a visual representation of information related to the operation of the HVAC system. For example, the electronic display may be used to view, configure, and/or modify operation of the zone control panel and/or other devices implemented in the HVAC system. Further, as devices and/or equipment in the HVAC system may utilize different respective user interfaces, the zone control panel may reproduce the user interfaces on its electronic display. In other words, the zone control panel may centralize presentation of relevant information and/or present the relevant in a familiar manner, which, at least in some instances, may facilitate improving user interaction with the HVAC system.

To facilitate further improving user interaction with the HVAC system, in some embodiments, the electronic display implemented on the zone control panel may provide a configurable split-screen view. For example, in a zoned HVAC system, the electronic display may provide information related a sub-set of zones services by the HVAC system. In other words, the split-screen view may facilitate user interaction with a number of data types and/or data sources from the HVAC system, for example, by enabling a user to rapidly compare operational parameters of different zones and/or to determine additional details regarding operation of the HVAC system.

Accordingly, the present disclosure provides techniques to facilitate increasing operational flexibility and/or increasing usability of a control system within an HVAC system. For example, by controlling operation of devices and/or equipment in the HVAC system across multiple zones and/or for the entire HVAC system, the zone control panel may provide greater operational flexibility to the HVAC system. Further, by consolidating data sources and/or reproducing recognizable or familiar user interfaces on the electronic display of the zone control panel, information related to the HVAC system may more readily be obtained, compared, and understood.

Turning now to the drawings, FIG. 1 illustrates a heating, ventilating, and air conditioning (HVAC) system for building environmental management that may employ one or more HVAC units. In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

In any case, the HVAC unit 12 may be air cooled device that implements a refrigeration cycle to provide conditioned air to the building 10. For example, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the air is conditioned, the HVAC unit 12 may supply the conditioned air to the building 10 via ductwork 14 extending throughout the building 10 from the HVAC unit 12. For example, the ductwork 14 may extend to various individual floors or other sections of the building 10. In some embodiments, the HVAC unit 12 may be a heat pump that provides both heating and cooling to the building 10, for example, with one refrigeration circuit implemented to operate in multiple different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through the ductwork 14. In some embodiments, other devices may be included in the system, such as pressure and/or temperature transducers or switches that sense the temperatures and pressures of the supply air, return air, and/or the like. Moreover, the control device 16 may include computer systems that are integrated with or separate from other building control or monitoring systems, and even systems that are remote from the building 10.

Figure 2:
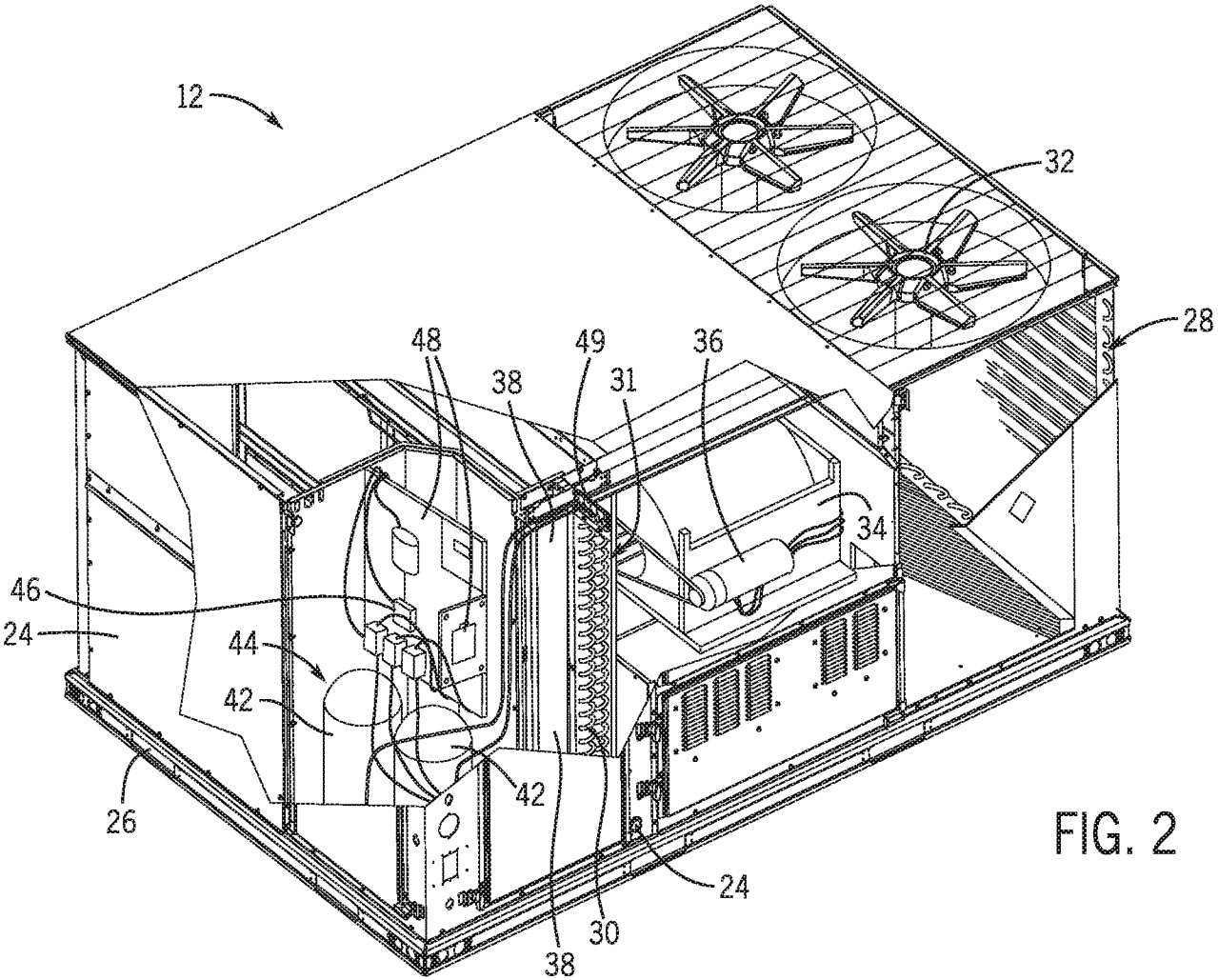
FIG. 2 is a perspective view of a HVAC unit of the HVAC system of FIG. 1, in accordance with an embodiment of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, and/or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12, for example, to provide structural support and/or protection to the internal components from environmental contaminants and/or other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements, such as rain, from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and/or the like. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream.

In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

As depicted, the heat exchanger 30 is located within a compartment 31 that separates the heat exchanger 30 from the heat exchanger 28. Fans 32 may draw air from the environment through the heat exchanger 28. Air may be heated and/or cooled as it flows through the heat exchanger 28 before being released back to the environment surrounding the rooftop unit 12. A blower assembly 34, powered by a motor 36, may draw air through the heat exchanger 30 to heat or cool the air. The heated or cooled air may be directed to the building 10 by the ductwork 14 connected to the HVAC unit 12. Before flowing through the heat exchanger 30, the conditioned air may flow through one or more filters 38 that may remove particulates and/or other contaminants from the air. In certain embodiments, the filters 38 may be disposed on the air intake side of the heat exchanger 30 to reduce likelihood of contaminants contacting the heat exchanger 30.

The HVAC unit 12 also may include other equipment for implementing the thermal cycle. Compressors 42 increase the pressure and/or temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and/or devices may be included in the HVAC unit 12, such as a solid-core filter drier, a drain pan, a disconnect switch, an economizer, pressure switches, phase monitors, and humidity sensors, among other things.

The HVAC unit 12 may receive electrical power via a terminal block 46. For example, a high voltage power source may be connected to the terminal block 46 to power the equipment. The operation of the HVAC unit 12 may be governed or regulated by a control board 48. The control board 48 may include control circuitry connected to a thermostat, a sensor, and/or an alarm. One or more of these components may be referred to herein separately or collectively as the control device 16. The control circuitry may be implemented to control operation of the equipment, provide alarms, and/or monitor safety switches. Wiring 49 may connect the control board 48 and the terminal block 46 to the equipment of the HVAC unit 12.

Figure 3:
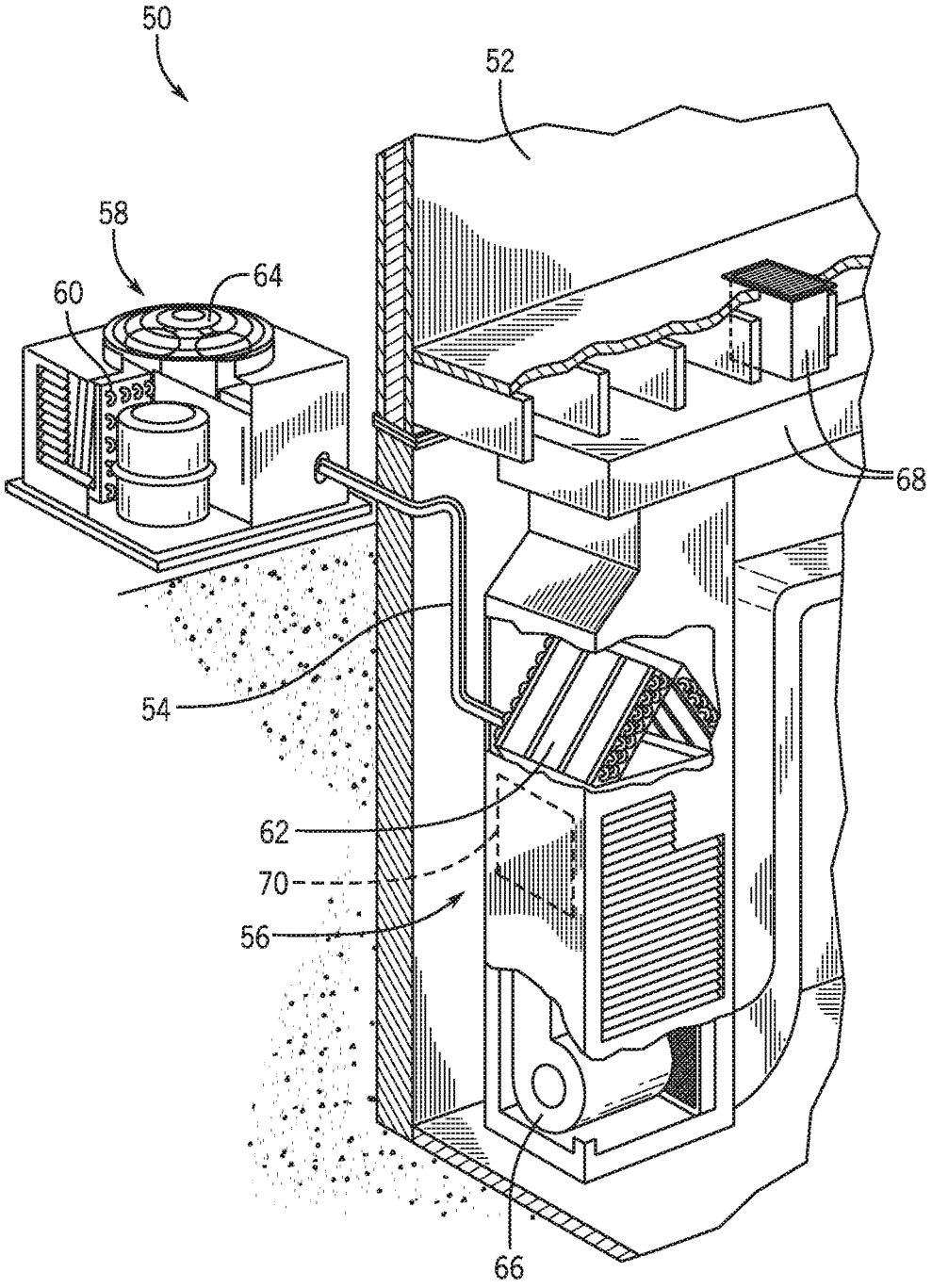
FIG. 3 illustrates a residential heating and cooling system, in accordance with an embodiment of the present disclosure.

FIG. 3 illustrates a residential heating and cooling system 50, also in accordance with present techniques. The residential heating and cooling system 50 may provide heated air to a residential structure, cooled air to the residential structure, outside air for ventilation, and/or improved indoor air quality (IAQ) through devices, such as ultraviolet lights and/or air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components, for example, to prevent leaves and other debris or contaminants from entering the unit. The refrigerant conduits 54 may transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 may serve as a condenser for re-condensing vaporized refrigerant flowing from the indoor unit 56 to the outdoor unit 58 via one of the refrigerant conduits 54. In these applications, a heat exchanger 62 of the indoor unit may function as an evaporator. Specifically, the heat exchanger 62 may receive liquid refrigerant, which is expanded by an expansion device, and evaporate the refrigerant before returning it to the outdoor unit 58.

The outdoor unit 58 may draw environmental air through the heat exchanger 60 using a fan 64 and expel the air above the outdoor unit 58. When operating as an air conditioner, the air heated by the heat exchanger 60 within the outdoor unit 58 exits the unit at a temperature higher than it entered. The indoor unit 56 includes a blower or fan 66 that directs air through or across the indoor heat exchanger 62, where the air is cooled when the system is operating in an air conditioning mode.

Thereafter, the air may be passed through ductwork 68 that directs the air to the residence 52. The overall system operates to maintain a desired temperature as set by a system controller. When the temperature sensed inside the residence 52 is higher than the setpoint on the thermostat, or the setpoint plus a small amount, the residential heating and cooling system 50 may operate to refrigerate or cool additional air for circulation through the residence 52. When the temperature reaches the setpoint, or the setpoint minus a small amount, the residential heating and cooling system 50 may stop or pause the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 may serve as an evaporator to evaporate refrigerant and, thus, cool air entering the outdoor unit 58 as the air passes over outdoor the heat exchanger 60. The indoor heat exchanger 62 may receive a stream of air blown over it and heat the air by condensing the refrigerant.

In some embodiments, the indoor unit 56 may include a furnace system 70. For example, the indoor unit 56 may include the furnace system 70 when the residential heating and cooling system 50 is not implemented to operate as a heat pump. The furnace system 70 may include a burner assembly and heat exchanger, among other components, inside the indoor unit 56. Fuel may be provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
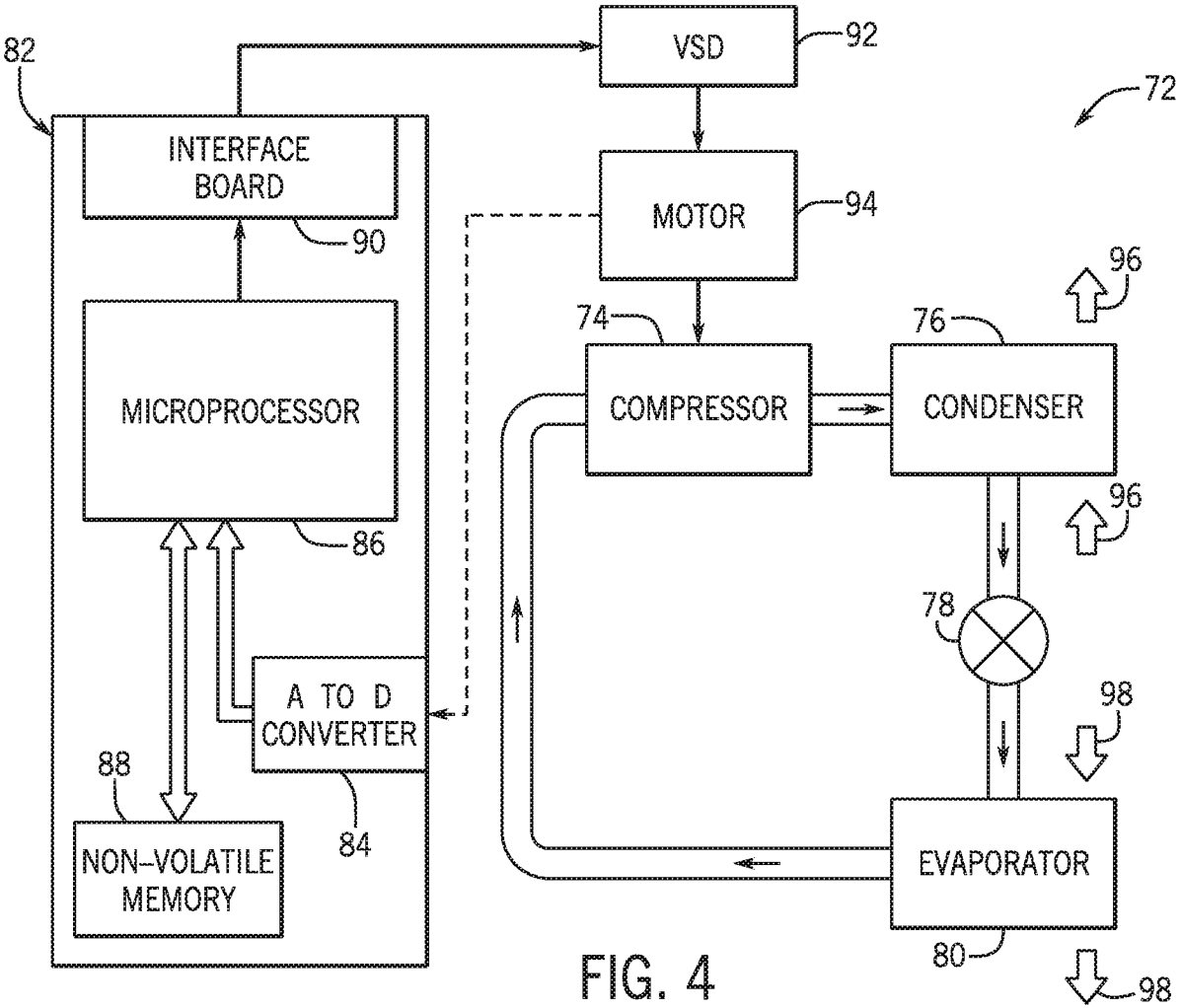
FIG. 4 illustrates a vapor compression system that may be used in the HVAC system of FIG. 1 and in the residential heating and cooling system of FIG. 3, in accordance with an embodiment of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, one or more expansion valves or devices 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and/or the like.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may be powered by the variable speed drive (VSD) 92 to drive the compressor 74. The VSD 92 may receive alternating current (AC) power having a particular fixed line voltage and fixed line frequency from an AC power source, and provide power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 mat compress a refrigerant vapor and deliver the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant may exit the evaporator 80 and return to the compressor 74 by a suction line to complete the cycle.

In some embodiments, the vapor compression system 72 may further include a reheat coil in addition to the evaporator 80. For example, the reheat coil may be positioned downstream of the evaporator 80 relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC system. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

The description above with reference to FIGS. 1-4 is intended to be illustrative of the context of the present disclosure. The techniques of the present disclosure may update features of the description above. In particular, as will be discussed in more detail below, one or more zone control panels may be implemented in the HVAC system, for example, to facilitate improving operational flexibility and/or to usability of the HVAC system.

Figure 5:
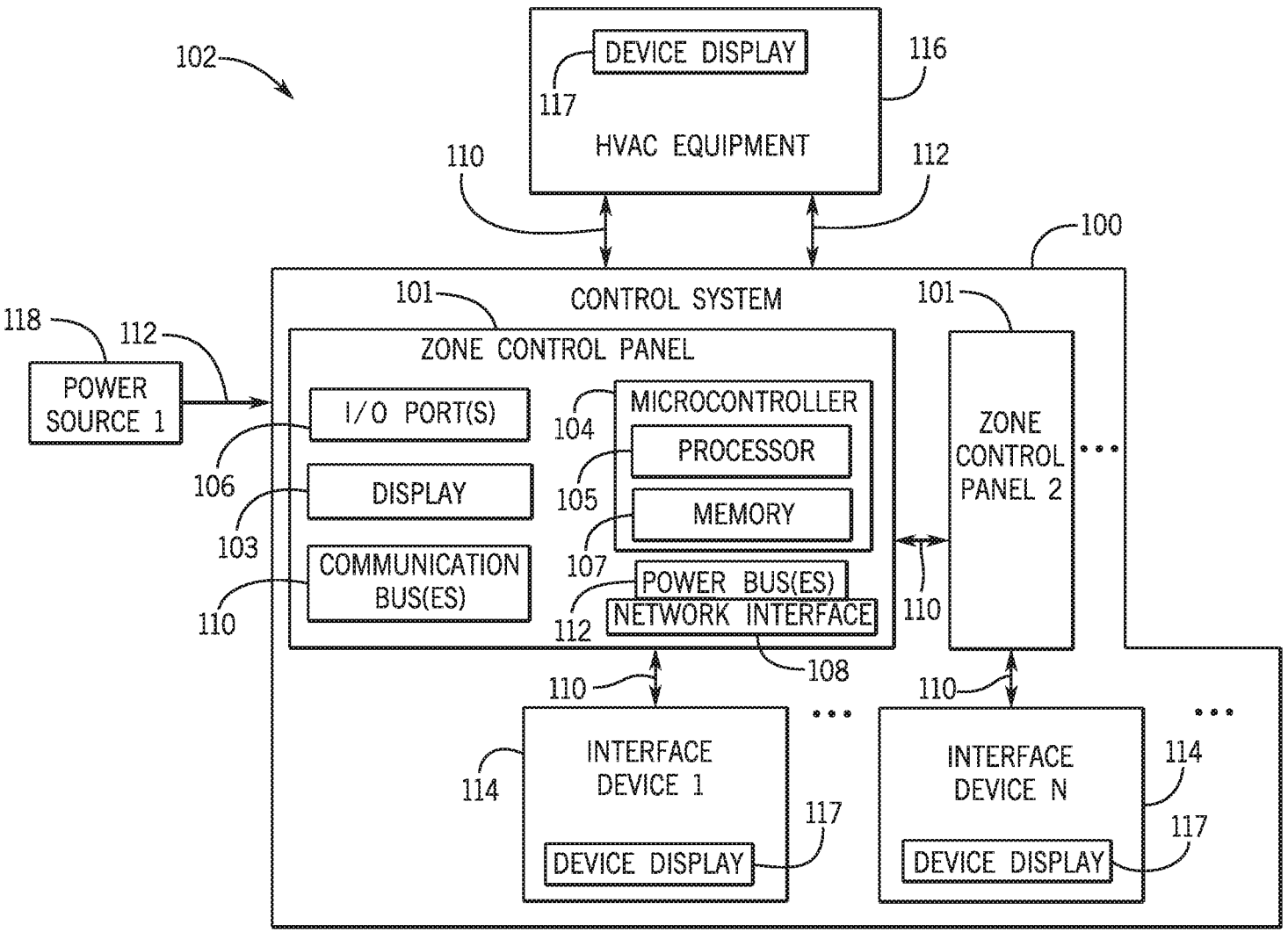
FIG. 5 is a block diagram of a portion of the HVAC system of FIG. 1 including a control system implemented using one or more zone control panels, in accordance with an embodiment of the present disclosure.

To help illustrate, a control system 100 that includes one or more zone control panels 101, which may be used to facilitate controlling operation of equipment in an HVAC system 102, is shown in FIG. 5. In some embodiments, a zone control panel 101 may include a zone control panel electronic display 103, a microcontroller 104, a network interface 108, one or more input/output (I/O) ports 106, one or more communication buses 110, and one or more power buses 112. The microcontroller 104 may include a processor 105, such as microprocessor 86, and memory 107, such as non-volatile memory 88, to facilitate controlling operation of the HVAC system 102.

For example, the microcontroller 104 may communicate control commands instructing HVAC equipment 116, such as a VSD 92, to perform a control action, such as adjust the speed of the motor 94. In some embodiments, the microcontroller 104 may determine control commands based on user inputs received from the zone control panel electronic display 103, user inputs received from an interface device 114, and/or operational parameters, such as speed, temperature, and/or pressure, indicated by the HVAC equipment 116 and/or a sensor. For example, the interface device 114, such as a thermostat, may receive an input to change a temperature setpoint for a first zone serviced by the HVAC system 102 and/or determine measured temperature in the first zone using one or more temperature sensors. In any case, the zone control panel 101 may receive the input and/or the measured temperature from the interface device 114 and may transmit a control command to the HVAC equipment 116 to adjust the temperature in the zone based on the input and/or the measured temperature in the zone.

Thus, to facilitate controlling operation of the HVAC system 102, a zone control panel 101 may include one or more I/O ports 106 that enable the zone control panel 101 to communicatively couple to an interface device 114, such as a zone thermostat or a master thermostat, another zone control panel 101, and/or HVAC equipment 116 via an external communication bus 110. In some embodiments, an external communication bus 110 may include one or more off-board connections, such as wires and/or cables. Additionally, the I/O ports 106 may be communicatively coupled to the microcontroller 104 via internal or on-board communication buses 110. In some embodiments, an internal communication bus 110 may include one or more on-board connections, such as PCB traces. In this manner, the communication buses 110 may enable the zone control panel 101 to control operation of a device, such as an interface device 114, another zone control panel 101, and/or HVAC equipment 116.

Additionally or alternatively, the zone control panel 101 may include the network interface 108 to enable communication with an interface device 114, another zone control panel 101, HVAC equipment 116, and/or other suitable devices over a network. The network interface 108 may include, for example, one or more interfaces for a personal area network (PAN), such as a Bluetooth network, a local area network (LAN) or wireless local area network (WLAN), such as an 802.11x Wi-Fi network, and/or a wide area network (WAN), such as a $3^{rd}$ generation (3G) cellular network, a $4^{th}$ generation (4G) cellular network, a long term evolution (LTE) cellular network, a long term evolution enhanced license assisted access (LTE-eLAA) cellular network, a long term evolution advanced (LTE-A) cellular network, and/or the like. The network interface 108 may also include one or more interfaces for, for example, broadband fixed wireless access networks (WiMAX), mobile broadband Wireless networks (mobile WiMAX), asynchronous digital subscriber lines (e.g., ADSL, VDSL), digital video broadcasting-terrestrial (DVB-T) and its extension DVB Handheld (DVB-H), ultra-Wideband (UWB), alternating current (AC) power lines, and/or the like.

In some embodiments, the device may operate using electrical power. Thus, to facilitate controlling operation of a device, the zone control panel 101 may also control supply of electrical power from power sources 118 to the device via power one or more busses 112. For example, the zone control panel 101 may receive electrical power from a power source 118, such as an indoor transformer or an outdoor transformer, and/or another zone control panel 101 via external power buses 112. In some embodiments, an external power bus 112 may include one or more off-board connections. Additionally, the zone control panel 101 may output electrical power to HVAC equipment 116 and/or another zone control panel 101 via additional external power buses 112 coupled to its I/O ports 106. The zone control panel 101 may also route electrical power between its components, such as the zone control panel electronic display 103, the microcontroller 104, and/or the like, via internal power buses 112. In some embodiments, an internal power bus 112 may include one or more on-board connections.

In some embodiments, the zone control panel electronic display 103 may be a liquid crystal display (LCD), an organic light emitting diode (OLED) display, and/or the like. Additionally, in some embodiments, the zone control panel electronic display 103 may include a touch screen, which may enable a user to interact with the zone control panel 101. Additionally or alternatively, the zone control panel 101 may include one or more input structures or devices, such as a keyboard, touchpad, a mechanical button, and/or push button, which may enable a user to interact with the zone control panel 101.

In any case, as described in greater detail below, the zone control panel 101 may provide additional functionality and/or increased usability to the HVAC system 102. For example, because the zone control panel 101 may communicatively couple to any suitable number of interface devices 114 and/or HVAC equipment 116, a user, such as a technician, a system integrator, and/or a manufacturer of the HVAC system 102 may use the zone control panel 101 to configure or set up operation settings of the HVAC equipment 116. That is, for example, the zone control panel 101 may be used to configure airflow settings in the HVAC system 102, which may involve setting and/or storing minimum airflows and/or maximum airflows for each zone serviced by the HVAC system 102, the HVAC system 102 as a whole, or both. The zone control panel 101 may further use the airflow configuration information to suitably instruct the operation of the HVAC equipment 116 via the microcontroller 104. Additionally or alternatively, in the case of a zoned HVAC system 102, the zone control panel 101 may set up the zones in the HVAC system 102, for example, by associating suitable HVAC equipment 116 with a respective zone and/or by adding, editing, and/or removing borders between one or more zones.

Further, based on the configuration settings, the zone control panel 101 may be used to determine how to suitably condition and/or deliver conditioned air to one or more zones serviced by the HVAC system 102. For example, the zone control panel 101 may control bleeding of excess air delivered to the HVAC system 102 by adjusting the position of one or more dampers automatically and/or in response to a user input received at the zone control panel 101, for example, via the input structures and/or the zone control panel electronic display 103. The conditioning of air may further be controlled via the zone control panel 101, which may facilitate adjustments to the humidification and/or dehumidification of air, the differential between the measured temperature in the HVAC system 102 and the set point temperature in the HVAC system 102 before a response to the demand is initiated, the speed of response to demand in the HVAC system 102, level of response to demand in the HVAC system 102, and/or the like.

In some embodiments, the zone control panel 101 may control and/or facilitate configurable staging of HVAC equipment 116, such as an HVAC unit 12, so that how and/or when the HVAC equipment 116 transitions from a first stage of heating or cooling to a second stage of heating or cooling may be adjusted. Further, the zone control panel 101 may be used to diagnose an issue and/or verify the setup of the HVAC system 102, for example, by providing information related to the wiring setup of one or more dampers, wiring setup of other HVAC equipment 116, faults present in the HVAC system 102, and/or the like.

Further, in some embodiments, using the network interface 108, the zone control panel 101 may receive and/or transmit update information, such as a software and/or a firmware update. Accordingly, suitable updates to the zone control panel 101 may automatically be installed, for example, via a Wi-Fi or other wireless connection. Further, the zone control panel 101 may receive, via the network interface 108, update information for any suitable HVAC equipment 116 and/or interface device 114 and may transmit the update information to the HVAC equipment 116 and/or interface device 114. Additionally or alternatively, in some embodiments, the zone control panel 101 may, using the microcontroller 104, process the update information and suitably instruct the HVAC equipment 116 and/or the interface device 114 based in part on the processed update information in order to install updated and/or additional software.

The HVAC system 102 may include any suitable number of zone control panels 101. For example, in the case of a zoned HVAC system 102, which may include two or more zones each implemented provide a respective independent demand for conditioned air, the HVAC system 102 may include a zone control panel 101 for each zone. In any case, each zone control panel 101 in the HVAC system 102 may be implemented to provide control over at least a portion of the HVAC system 102. That is, for example, while a first zone control panel 101 may reside in a first zone of the HVAC system 102, the first zone control panel 101 may control operation of HVAC equipment 116, such as one or more dampers, associated with a second zone in the HVAC system 102. Similarly, a second zone control panel 101 located in the second zone may control the one or more dampers in the second zone and may also control operation of HVAC equipment 116 associated with the first zone.

To do so, in some embodiments, one or more of the zone control panels 101 may communicate with the HVAC equipment 116 and/or the interface devices 114 in the HVAC system 102. Additionally or alternatively, a first set of zone control panels 101 may communicate with a first set of the suitable HVAC equipment and/or interface devices 114 and a second set of zone control panels 101 may communicate with a second set of the suitable HVAC equipment and/or interface devices 114. In such embodiments, the first set of zone control panels 101 and the second set of zone control panels 101 may communicate with one another so that, for example, information, such as sensor data, received at the first set of zone control panels 101 from the first set of HVAC equipment 116 may be transmitted to the second set of zone control panels 101 and control commands from the second set of zone control panels 101 may be transmitted via the first set of zone control panels 101 to the first set of the HVAC equipment 116.

In some embodiments, a device communicatively coupled to the zone control panel 101, such as HVAC equipment 116, an interface device 114, and/or a sensor communicatively coupled to the HVAC equipment 116 and/or the interface device, may include a device electronic display 117 suitable to provide information related to the operation of the device. For example, an HVAC unit 12 may include and/or communicatively couple to one or more sensors, such as a manifold gauge, a thermometer, a hygrometer, a vacuum gauge, an anemometer, a leak detector, a clamp meter, an ammeter, and/or the like that may measure and/or determine operating and/or environmental parameters, such as pressure, temperature, humidity, airflow, and/or the like associated with the HVAC unit 12. In some embodiments, HVAC equipment 116 may include an interface, such as an analog gauge interface and/or a digital readout, to provide information related to the device, as described above, to a user, such as a technician.

Figure 6:
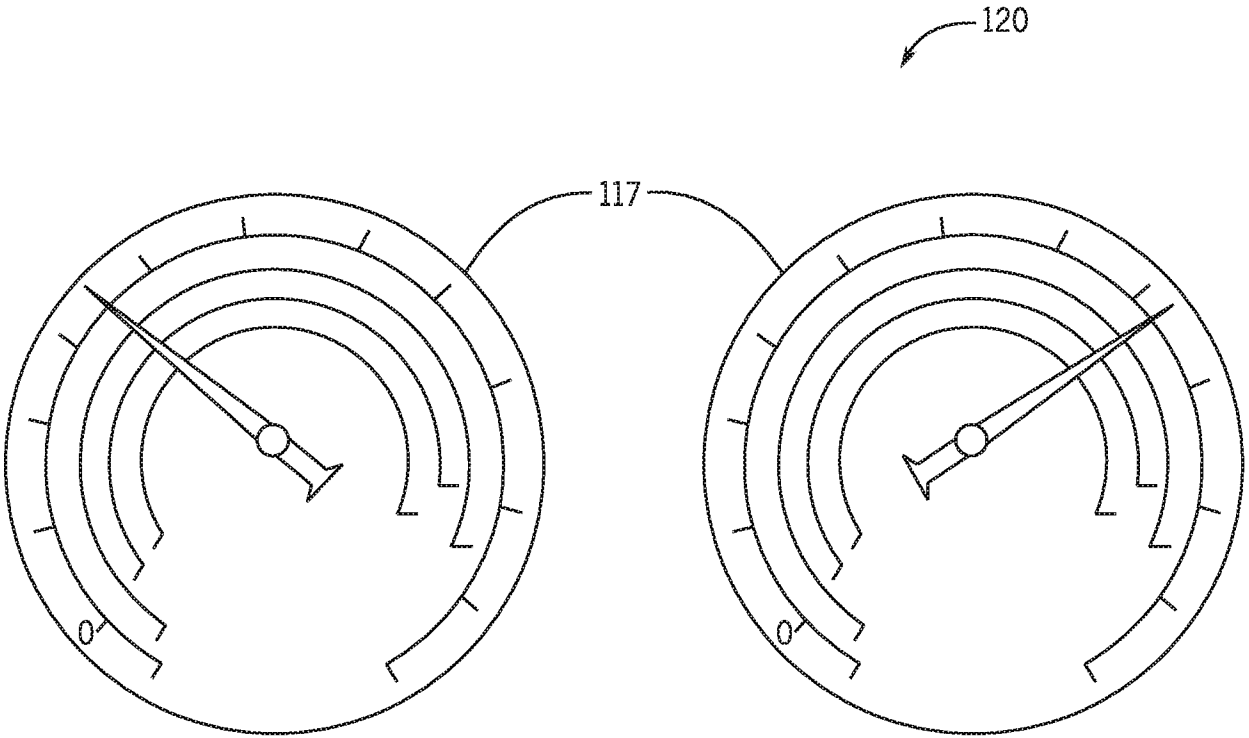
FIG. 6 illustrates an example of a user interface provided on a device implemented in the HVAC system of FIG. 1, in accordance with an embodiment of the present disclosure.

Turning now to FIG. 6, an example of an interface 120 that may be provided on a device electronic display 117 is illustrated. While the illustrated embodiment may represent an analog interface, in some embodiments, the device electronic display 117 may include a digital and/or graphic interface, such as a graphical user interface (GUI). In any case, as described above, the device electronic display 117 may provide information related to the operation and/or the operational state of the HVAC equipment 116 and/or the interface device 114.

Accordingly, in some embodiments a manufacturer, a system integrator, and/or a technician, for example, may use the device electronic display 117 as a diagnostic tool in the HVAC system 102. For example, a technician may identify an issue with a device in the HVAC system 102 via the device electronic display 117 and/or may determine how to address an issue in the HVAC system 102 via the device electronic display 117. Additionally or alternatively, the system integrator, technician, and/or a suitable user may use the device electronic display 117 to determine the effect of settings in the HVAC system 102 on the HVAC equipment 116. That is, for example, the device electronic display 117 may be used to determine how a control command received from the zone control panel 101 impacted the operation of the HVAC equipment 116.

In some embodiments, however, such as in the case of an outdoor HVAC unit 58, the device electronic display 117 may be separate and remote from the zone control panel 101. In such cases, for example, a technician, system integrator, and/or other suitable user may set configuration settings on the zone control panel 101 at a first location (e.g., indoors) and may diagnose the operation of the HVAC equipment 116 resulting from the configuration settings at a second location (e.g., outdoors) that is separate and remote from the first location.

Accordingly, in some embodiments, the zone control panel 101 may use the zone control panel electronic display 103 to provide information included in the device electronic display 117 in a centralized location. More specifically, in some embodiments the zone control panel 101 may use the zone control panel electronic display 103 to reproduce (e.g., mirror) the interface 120 provided by the device electronic display 117 so that information related to the HVAC equipment 116 via the zone control panel electronic display 103 may be provided to a technician, system integrator, and/or other suitable user with a familiar and/or recognizable interface. To do so, the zone control panel 101 may communicate with the HVAC equipment 116 and/or the device electronic display 117 in order to determine a suitable interface and/or data to illustrate with the suitable interface on the zone control panel electronic display 103.

Figure 7:
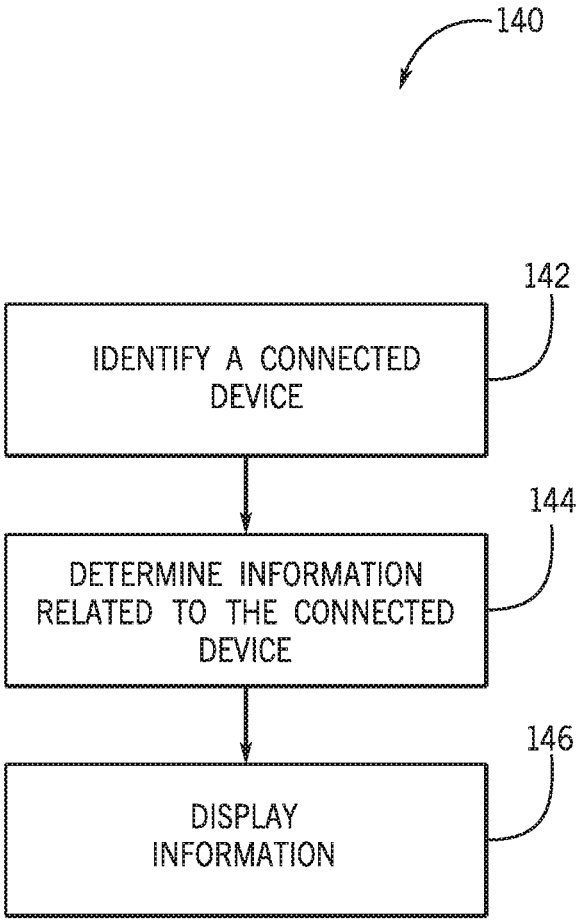
FIG. 7 is a flow diagram of a process for displaying information related to a device in the HVAC system on an electronic display of a zone control panel of FIG. 5, in accordance with an embodiment of the present disclosure.

In any case, an example of a process 140 for updating the zone control panel electronic display 103 is described in FIG. 7. Although the following description of the process 140 is described in a particular order, which represents a particular embodiment, it should be noted that the process 140 may be performed in any suitable order. Moreover, embodiments of the process 140 may omit process blocks and/or include suitable additional process blocks.

Generally, the process 140 includes identifying a device connected to a zone control panel (process block 142), determining information related to the connected device (process block 144), and displaying the information (process block 146). In some embodiments, the process 140 may be implemented at least in part by executing instructions stored in a tangible, non-transitory, computer-readable medium, such as memory 107, using processing circuitry, such as processor 105. Additionally or alternatively, the process 140 may be implemented at least in part by the zone control panel 101, a manufacturer of HVAC equipment 116, and/or a system integrator of the HVAC system 102.

In any case, identifying a device, such as an interface device 114 and/or HVAC equipment 116, connected to the zone control panel 101 (process block 142) may involve receiving, at the zone control panel 101, an input identifying the device connected and/or to be connected to the zone control panel 101 from one or both of the device or a manufacturer, system integrator, and/or other suitable user of the HVAC system 102. Identifying the device may involve identifying one or more of a manufacturer, a model number, an HVAC equipment type, and/or the like associated with the device. Accordingly, receiving an input from the device may involve the device, after communicatively coupling to the zone control panel 101, communicating one or more of its attributes, as described above, to the zone control panel 101. On the other hand, receiving an input from the manufacturer, system integrator, and/or other suitable user of the HVAC system 102 may involve, receiving identification information related to the device via, for example, inputs and/or selections provided at the zone control panel electronic display 103 through a touch screen interface and/or one or more input structures.

After identifying the device connected to the zone control panel 101, the zone control panel 101 may determine suitable information related to the connected device (process block 144). The information may include, among other things, additional identification information related to the device, an interface 120 used, for example, by the device electronic display 117, and/or data, such as operational parameters or configuration settings, related to the operation of the connected device. For example, the zone control panel 101 may determine an interface 120, such as an analog interface and/or a GUI displayed on the device electronic display 117 of the device (e.g., HVAC equipment 116 and/or an interface device 114).

To do so, in some embodiments, the zone control panel 101 may use a table (e.g., data table) and/or a suitable data structure mapping device identification information, such as the model number of the device, to an interface 120 used by the device. Such a table and/or data structure may be stored in memory 107. Additionally or alternatively, the table and/or data structure may be stored in a suitable location distinct from the zone control panel 101 and accessed remotely from the zone control panel 101. In some embodiments, for example, the table and/or data structure may be accessed via the network interface 108.

In any case, the zone control panel 101 may also determine data, such as data related to the operation of the connected device, by receiving an input from the connected device and/or from one or more sensors operatively coupled to the connected device. That is, for example, the zone control panel 101 may determine data suitable to be displayed in a visual representation of the data on the interface of the device electronic display 117. Further, in some embodiments, the data may change based in part on the operation of the device and/or environmental conditions, such as temperature and/or humidity. Accordingly, the zone control panel 101 may determine updated data in response to receiving an additional input from the connected device and/or from the one or more sensors operatively coupled to the connected device and/or in response to periodically monitoring for changes in the data.

After determining the information related to the connected device, the information may be displayed (process block 146). In other words, the zone control panel 101 may instruct, via the microcontroller 104, the zone control panel electronic display 103 to provide the information. Thus, in some embodiments, the zone control panel electronic display 103 may reproduce a visual representation of the data and/or the updated data displayed on the device electronic display 117 using the data and the identified interface 120. As such, a user, such as a manufacturer, system integrator, and/or a technician of the HVAC system 102 already familiar with the interface 120 used by the device electronic display 117, may easily recognize the reproduced interface on the zone control panel electronic display 103 and the manner in which it conveys information related to the device.

Figure 8:
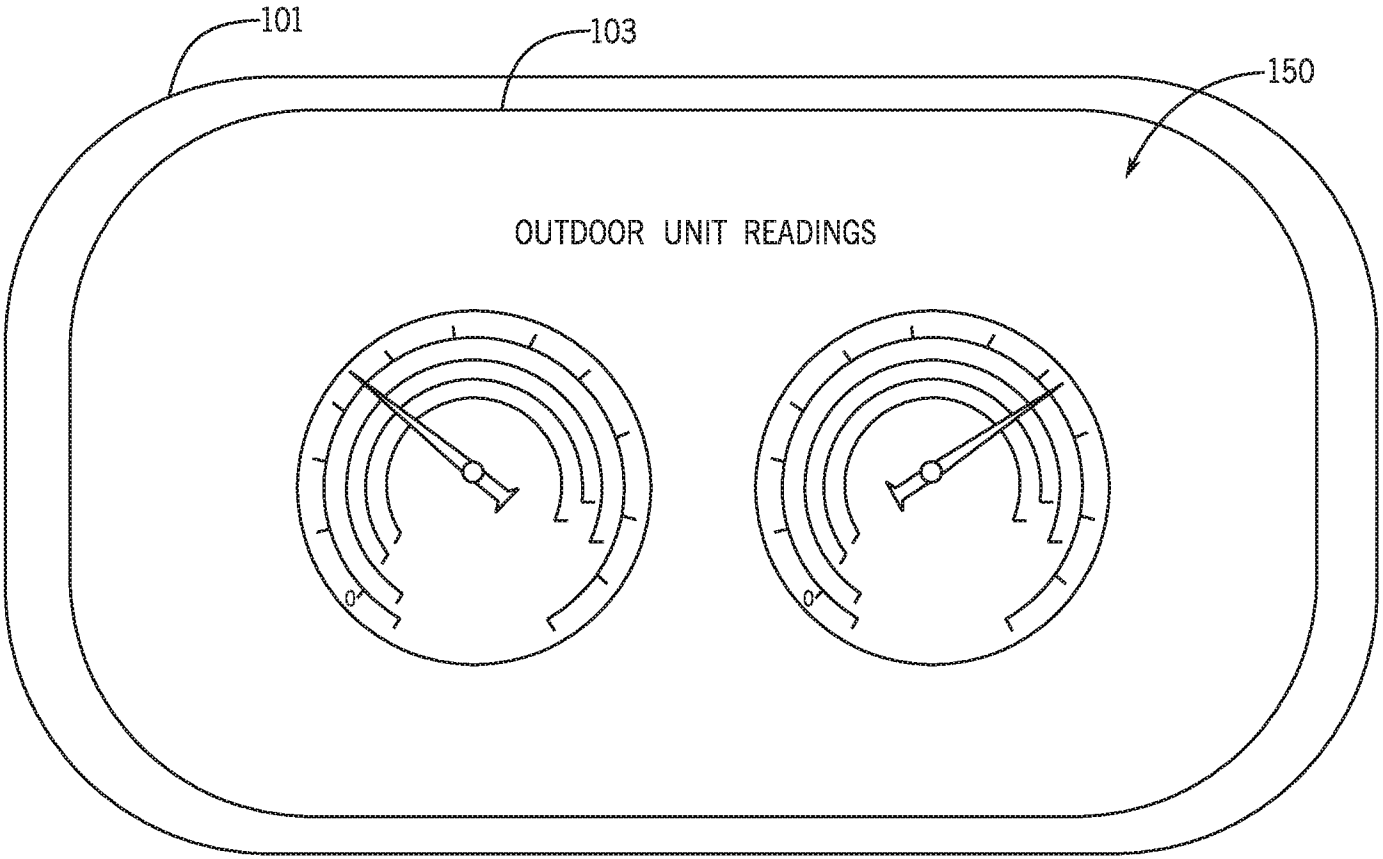
FIG. 8 illustrates an example of the zone control panel of FIG. 5 displaying a device screen that reproduces the user interface of FIG. 6, in accordance with an embodiment of the present disclosure.

As an illustrative example of displaying the information (process block 146), FIG. 8 depicts a reproduction of the interface 120 of the device electronic display 117 of FIG. 6 via an equipment interface data screen 150 or data page displayed on the zone control panel electronic display 103. Accordingly, the illustrated equipment interface data screen 150 includes the interface 120 used by the HVAC equipment 116 on the device electronic display 117 of FIG. 6. That is, the illustrated equipment interface data screen 150 includes a first analog gauge interface alongside a second analog gauge interface. Further, the illustrated zone control panel electronic display 103 indicates the data, which results from operation of the HVAC equipment 116, via the respective gauge readings displayed by the device electronic display 117.

As discussed, while the illustrated embodiment of the equipment interface data screen 150 reproduces an analog interface, the zone control panel electronic display 103 may additionally or alternatively reproduce a GUI and/or digital interface produced on a device electronic display 117. Further, in addition to reproducing an interface associated with a device electronic display 117, the zone control panel 101 may instruct, via the microcontroller, the zone control panel electronic display 103 to display additional information. For example, along with the interface reproduced from the device electronic display 117, the equipment interface data screen 150 may provide an additional interface reproduced from an additional device electronic display 117, a read out of a translation of the data provided by the reproduced interface on the zone control panel electronic display 103, insight or recommendations on how to adjust and/or improve the operation of the device based at least in part on the data, and/or the like. Accordingly, while a manufacturer, system integrator, and/or technician in the HVAC system 102 may recognize the reproduced interface provided on the zone control panel electronic display 103, the manufacturer, system integrator, and/or technician may also be able to more rapidly determine additional information, which may be related to the data included in the reproduced interface, than by solely examining a device electronic display 117.

Figure 9:
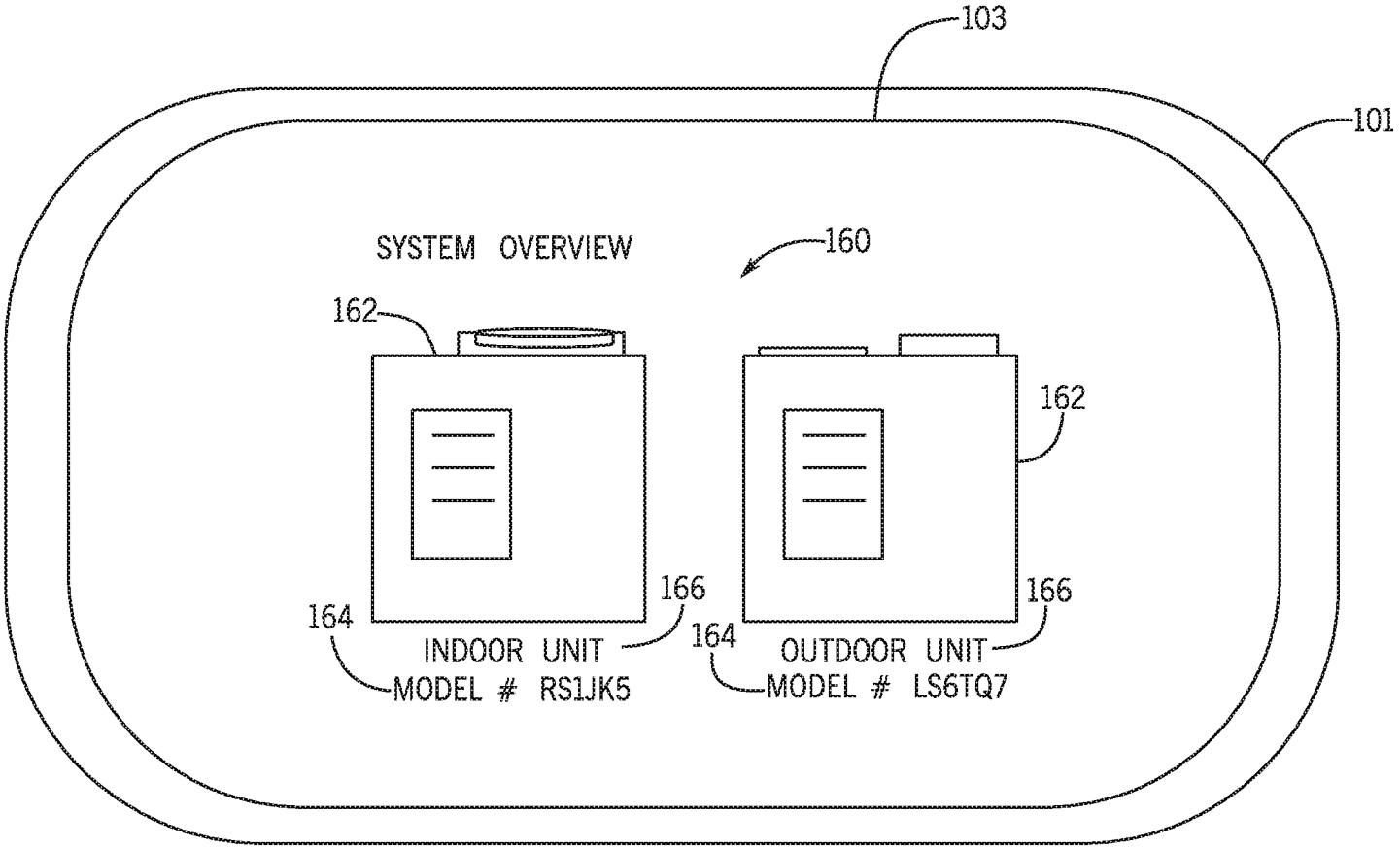
FIG. 9 illustrates an example of the zone control panel of FIG. 5 displaying a system overview screen, in accordance with an embodiment of the present disclosure.

Turning now to FIG. 9, the zone control panel 101 may additionally or alternatively use process 140 to provide a system overview data screen 160 on the zone control panel electronic display 103. The system overview data screen 160 may illustrate one or more devices in the HVAC system 102, such as an indoor HVAC unit 56 and/or an outdoor HVAC unit 58. More specifically, in some embodiments, the zone control panel electronic display 103 may provide a graphical representation 162, such as an icon or an image, of the one or more devices, such as HVAC equipment 116, interface device 114, and/or the like, in the HVAC system 102 such that a manufacturer, system integrator, technician, and/or another user may rapidly recognize each of the one or more devices by the appearance of the respective graphical representation 162.

In such embodiments, after identifying the connected devices in the HVAC system 102 (process block 142), the zone control panel 101 may, for example, determine the suitable graphical representation 162 of each of the connected devices (process block 144) and display the graphical representations 162 (process block 146). As described above with reference to the interface 120, the zone control panel 101 may determine the suitable graphical representation 162 of each of the connected devices based in part on a mapping of a connected device (e.g., identification information related to the connected device) to a suitable graphical representation 162 stored in memory 107 and/or remote from the zone control panel 101.

Further, in some embodiments, the system overview data screen 160 may provide HVAC equipment 116 identification information 164, such as a model number, which, as described above, may be determined based on an input received at the zone control panel 101. Additionally or alternatively, the system overview data screen 160 may include a customizable identifier 166, such as a nickname and/or alias, which may be used to more easily identify HVAC equipment 116. In such embodiments, a user, such as a manufacturer, system integrator, and/or a technician, may add, edit, and/or delete the respective customizable identifier 166 associated with each HVAC equipment 116.

Figure 10:
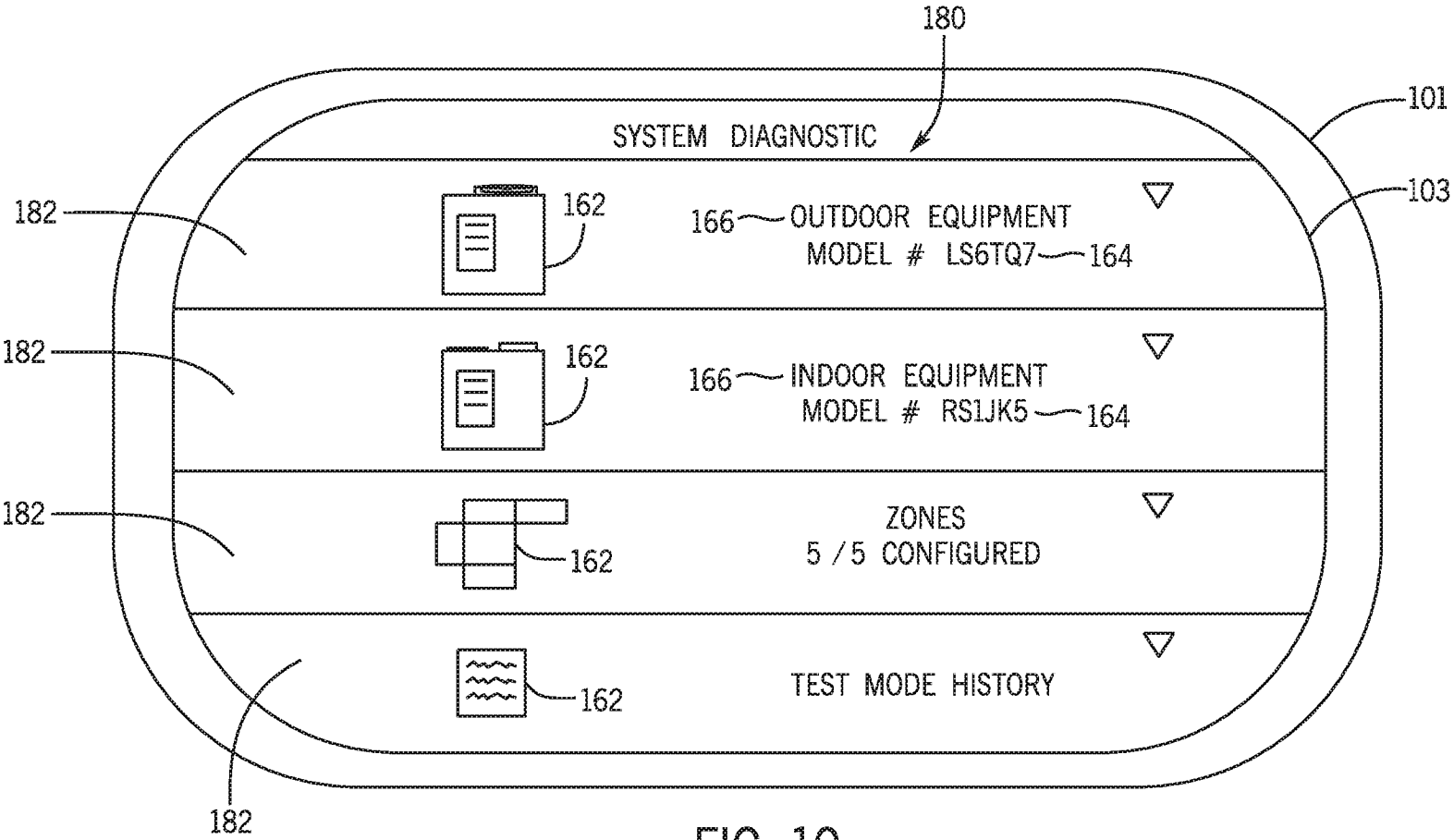
FIG. 10 illustrates an example of the zone control panel of FIG. 5 displaying a system diagnostic screen, in accordance with an embodiment of the present disclosure.

In some embodiments, the zone control panel 101 may include a system diagnostic data screen 180, which may provide a summary of diagnostic information related to the HVAC system 102, as illustrated in FIG. 10. Accordingly, the system diagnostic data screen 180 may include information related to one or more devices implemented in the HVAC system 102 and/or one or more zones serviced by the HVAC system 102, for example, including an identification information 164, a customizable identifier 166, and/or the like. Further, as described herein, because the zone control panel 101 may be implemented to control any suitable portion of the HVAC system 102, the system diagnostic data screen 180 may provide information related to the entire HVAC system 102. For example, for a zone control panel 101 in a first zone of an HVAC system 102 with multiple zones, the system diagnostic data screen 180 may compile information related to devices associated with the first zone, as well as information related to devices associated with each of the other zones in the HVAC system 102.

The system diagnostic data screen 180 may also include one or more graphical representations 162, such as an image and/or an icon, which may increase usability of the system diagnostic data screen 180. While these graphical representations 162 were described above with reference to one or more devices of the HVAC system 102, the graphical representations 162 may additionally or alternatively be associated with one or more data screens, such as an equipment interface data screen 150 or a system overview data screen 160, and/or with additional information displayed in any of the data screens.

In any case, the system diagnostic data screen 180 may include one or more information sections 182, which each indicates data relevant to a corresponding device, a data screen, and/or the like. For example, in the illustrated embodiment, the system diagnostic data screen 180 contains an information section 182 related to an outdoor HVAC unit 58 (e.g., outdoor unit). The data, such as the customizable identifier 166 and the identification information 164, represented in this information section 182 is related at least in part to the outdoor HVAC unit 58. Additionally or alternatively, as illustrated, the system diagnostic data screen 180 may include an information section 182 related to an indoor HVAC unit 56, an information section 182 related to the zones included in the HVAC system 102, and/or an information section 182 related to a history of test or checkout mode results used to calibrate the HVAC system 102 and/or to diagnose issues in the HVAC system 102, among other information sections 182. Further, in order to see additional information and/or to edit information, the information section 182 may be selected, expanded, and/or scrolled through based on one or more inputs received from a user at the zone control panel electronic display 103 and/or one or more input structures associated with the zone control panel electronic display 103.

The illustrated information sections 182 are intended to be illustrative and not limiting. Accordingly, in some embodiments, the system diagnostic data screen 180 and/or any other suitable data screen may additionally or alternatively include an information section 182 related to one or more dampers, a history of faults in any suitable portion of the HVAC system 102, additional HVAC equipment and/or interface devices 114, and/or the like.

Figure 11:
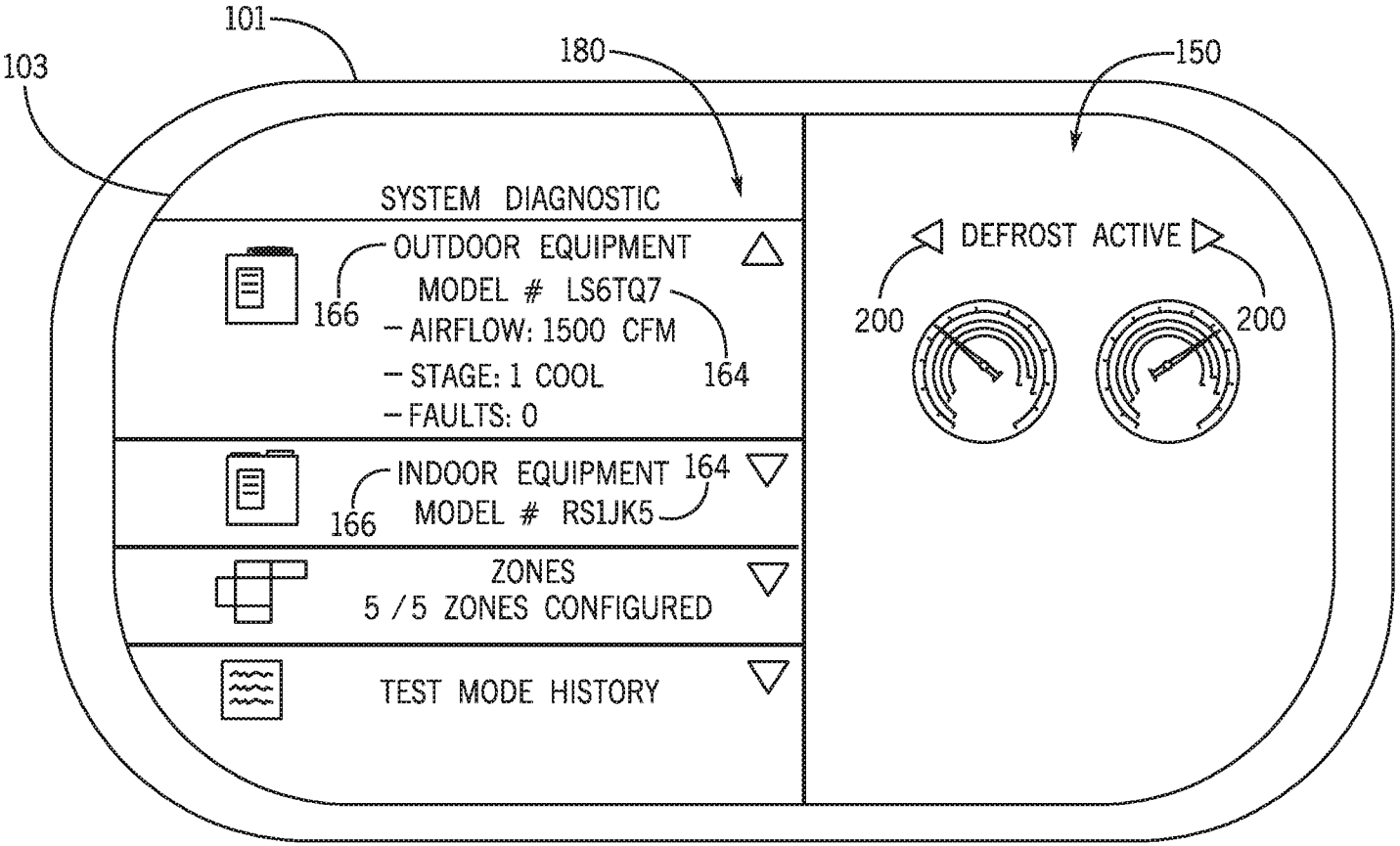
FIG. 11 illustrates an example of the zone control panel of FIG. 5 displaying a split screen that includes the device screen of FIG. 8 and the system diagnostic screen of FIG. 10, in accordance with an embodiment of the present disclosure.

In some embodiments, selecting and/or expanding an information section 182 may result in the zone control panel electronic display 103 simultaneously producing two or more data screens in distinct areas on the zone control panel electronic display 103, or in a split-screen view. For example, as illustrated in FIG. 11, selecting and/or expanding the information section 182 related to the outdoor HVAC unit 58 may cause the zone control panel electronic display 103 to digitally produce both the system diagnostic data screen 180 and the equipment interface data screen 150. In such cases, a user, such as a technician, may view information related to the outdoor HVAC unit 58 included in the information section 182, such as the airflow produced by the outdoor HVAC unit 58, the stage of heating and/or cooling the outdoor HVAC unit 58 is in, and/or the number of active faults associated with the outdoor unit 58 while viewing the information on the interface 120 of device electronic display 117 reproduced via the equipment interface data screen 150. Accordingly, a variety of visual representations of the data associated with a device, such as HVAC equipment 116, may be gathered into one or more areas of the zone control panel electronic display 103 so that a user may rapidly diagnose a current operation state and/or issue with the device based on any suitable combination of information included in the data.

Additionally, in some embodiments, the zone control panel 101 may include a default mapping of an action, such as selecting and/or expanding an information section and/or any other suitable action, to resulting data screens provided in the split-screen view described above. For example, the zone control panel 101 may automatically provide the data screens 180 and 150 of FIG. 11 in a split-screen view in response to a user interacting (e.g., selecting, scrolling, and/or expanding) with the information section 182 associated with the outdoor HVAC unit 58. However, in some embodiments, after the default data screens 180 and 150 are provided in the split-screen view on the zone control panel electronic display 103, a user may navigate through additional data screens related, for example, to the information section 182 and/or the device.

To help illustrate, continuing with the previous example, the outdoor HVAC unit 58 may include and/or communicatively couple to multiple sensors. As such, the outdoor HVAC unit 58 may include multiple device electronic displays 117 with interfaces 120 suitable to be reproduced on an equipment interface data screen 150. Accordingly, as illustrated in FIG. 11, the zone control panel electronic display 103 may facilitate swiping, scrolling, and/or proceeding through multiple equipment interface data screens 150 associated with the outdoor HVAC unit 58 in the portion of the zone control panel electronic display 103 displaying an equipment interface data screen 150. To advance through data screens, such as the equipment interface data screens 150, a user may interact with the zone control panel electronic display 103 through a touch-screen interface, which may include on-screen icons 200, and/or through one or more input structures.

Further, in some embodiments, the mapping of actions to resulting data screens provided in a split-screen view may be added, updated, and/or deleted. Accordingly, using the zone control panel 101, a user may customize both the split-screen views and the actions resulting in the customized split-screen views. For example, when viewing the information section 182 associated with the outdoor HVAC unit 58, the zone control panel 101, in response to the action of selecting the information section 182, may instruct the zone control panel electronic display 103 to provide the system diagnostic data screen 180 alongside an equipment interface data screen 150 associated with the one or more sensors in the zone. In such cases, for example, the technician may then better determine the effect of the outdoor HVAC unit's 12 operation on the zone. Further, in the case where multiple related data screens may be advanced through, as described above, the order in which such data screens are displayed may be adjusted.

Additionally, the zone control panel electronic display 103 may facilitate dynamically creating a split-screen view of two or more data screens. That is, for example, in addition to automatically providing a split-screen view in response to a certain action, such as the selection of suitable data, the zone control panel electronic display 103 may enable a user to drag and drop a first data screen into a first portion of the zone control panel electronic display 103 and to drag and drop a second data screen into a second portion of the zone control panel electronic display 103 to dynamically produce a split-screen view on the zone control panel electronic display 103. Additionally or alternatively, the user may dynamically create a split-screen view by selecting a split-screen mode, which may be included in a menu data screen, and once in the split-screen mode, select from among the suitable data screens to simultaneously view two or more data screens on the zone control panel electronic display 103.

While two data screens are simultaneously displayed in the illustrated embodiment, any suitable number of data screens may be produced on the zone control panel electronic display 103. Further the data screens may be arranged in any suitable organization. That is, for example, a first data screen may reside in a top portion of the zone control panel electronic display 103, while a second data screen may reside in the bottom portion of the zone control panel electronic display 103, not overlapping the top portion. Additionally or alternatively, the first data screen may reside in a left portion of the zone control panel electronic display 103, while the second data screen may reside in a right portion of the zone control panel electronic display 103, not overlapping the left portion. Further, the area of the zone control panel electronic display 103 taken up by a data screen may be configured to any suitable size, which may or may not match the area of the zone control panel electronic display 103 taken up by an additional data screen.

Figure 12:
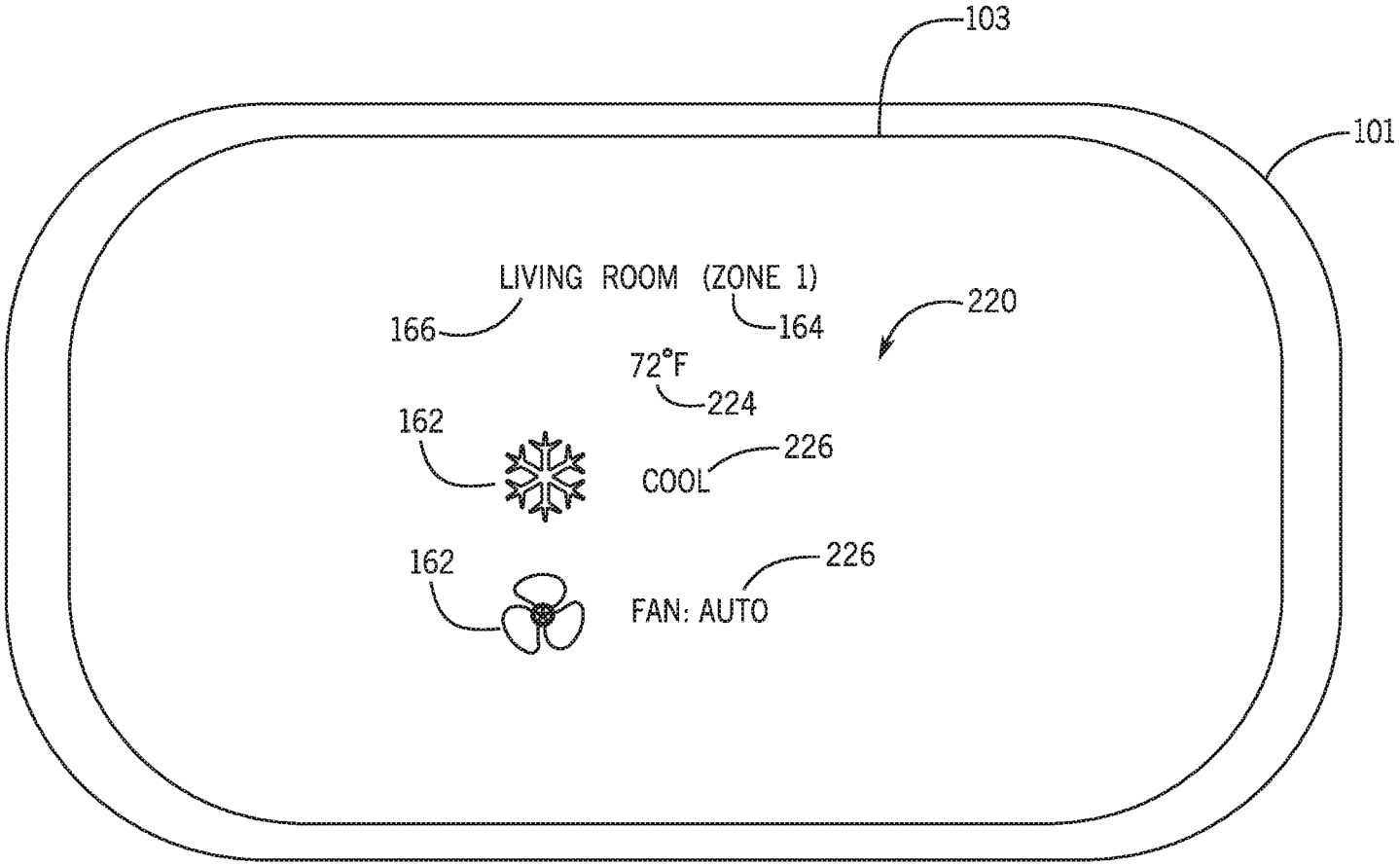
FIG. 12 illustrates an example of the zone control panel of FIG. 5 displaying a zone screen, in accordance with an embodiment of the present disclosure.

Turning now to FIG. 12, a zone settings data screen 220, which may be included in a split-screen view, as described herein, is illustrated. The zone control panel 101 may provide information related to a zone, as may be determined based in part on one or more sensors, an interface device 114, and/or HVAC equipment 116, on the zone settings data screen 220. Accordingly, in some embodiments, the zone settings data screen 220 may include information, such as identification information 164 and/or a customizable identifier 166 associated with the zone. Further, in some embodiments, the zone settings data screen 220 may indicate a temperature of the zone 224 and/or an operational state 226 of a device, such as HVAC equipment 116, associated with the zone. For example, the zone settings data screen 220 may indicate the fan setting associated with an HVAC unit 12 and/or stage of heating and/or cooling used by the HVAC unit 12. The zone settings data screen 220 may additionally or alternatively include additional and/or less information related to the zone. That is, the embodiment included in FIG. 12 is intended to be illustrative and not limiting.

As described herein, the zone control panel 101 may control operation of devices associated with any suitable number of zones, and the zone control panel 101 may provide a split-screen view of any suitable number of data screens on the zone control panel electronic display 103. Accordingly, turning to FIG. 13, in some embodiments, the zone control panel 101 may use the zone control panel electronic display 103 to simultaneously provide information related to each of multiple zones. That is, for example, the zone control panel electronic display 103 may provide a split-screen view of two or more zone settings data screens 220. Further, in some embodiments, as described herein, the number of and the zone settings data screens 220 displayed in the split-screen view may be adjusted. Accordingly, in some embodiments, the zone control panel electronic display 103 may include one or more on-screen icons 200 to facilitate a user adding or removing a zone settings data screen 220 to the split-screen view.

In some embodiments, the split-screen view of multiple zone settings data screens 220 and/or any suitable data screens may further facilitate simultaneously presenting additional information related to each of the respective displayed data screens, such as zone settings data screens 220. That is, for example, the zone control panel electronic display 103 may include an on-screen icon 200 that simultaneously provides additional information for each of multiple data screens. Additionally or alternatively, the zone control panel electronic display 103 may enable a user to simultaneously scroll and/or advance through multiple data screens. For example, if each of the data screens displayed in a split-screen view on the zone control panel electronic display 103 includes respective additional information that is not currently displayed and/or does not fit on the zone control panel electronic display 103, the user may scroll and/or advance the zone control panel electronic display 103 by for example, swiping up, down, left, or right, to view the respective additional information of each of the data screens.

Figure 13:
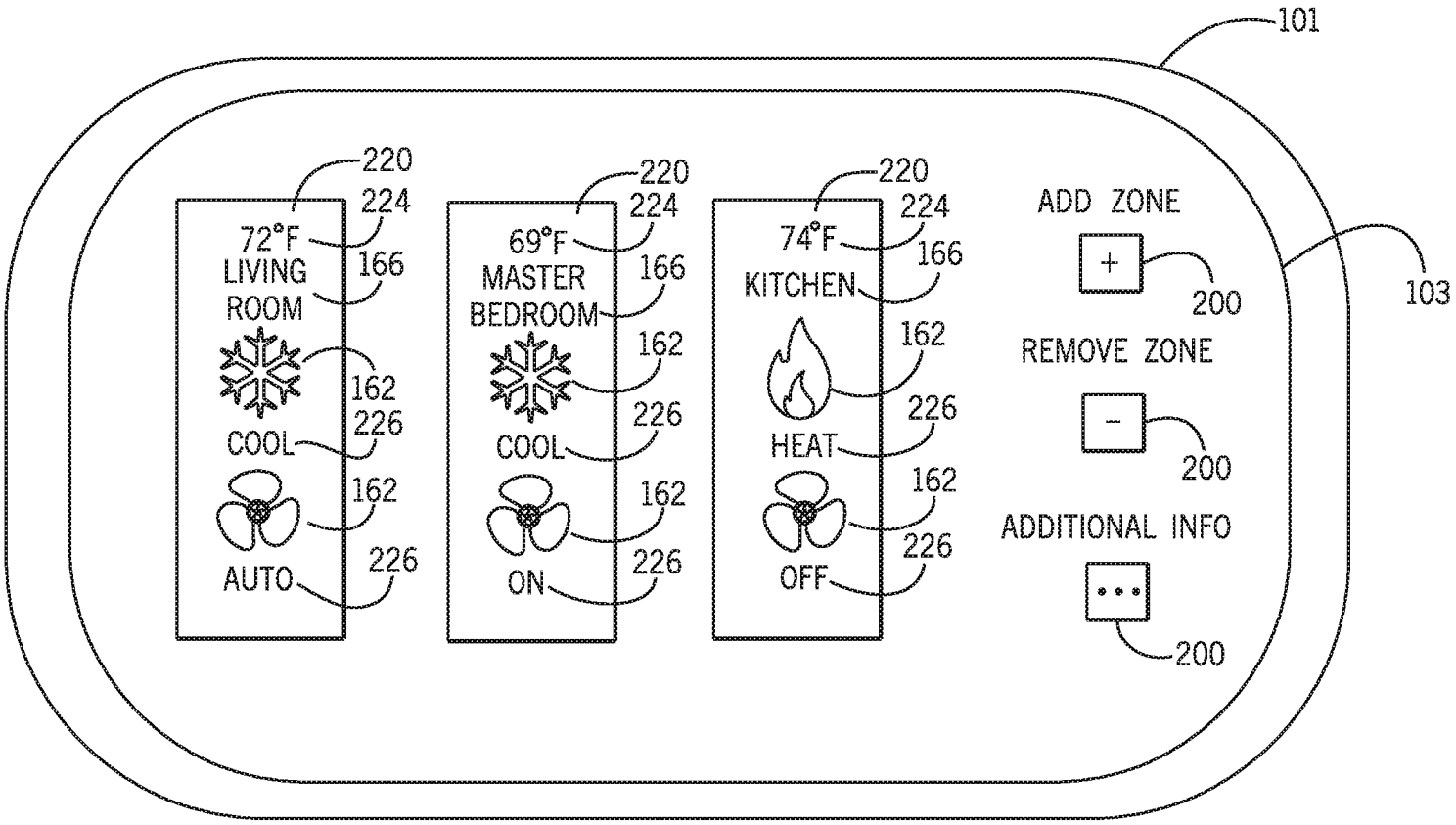
FIG. 13 illustrates an example of the zone control panel of FIG. 5 displaying a multi-zone screen, in accordance with an embodiment of the present disclosure.
Figure 14:
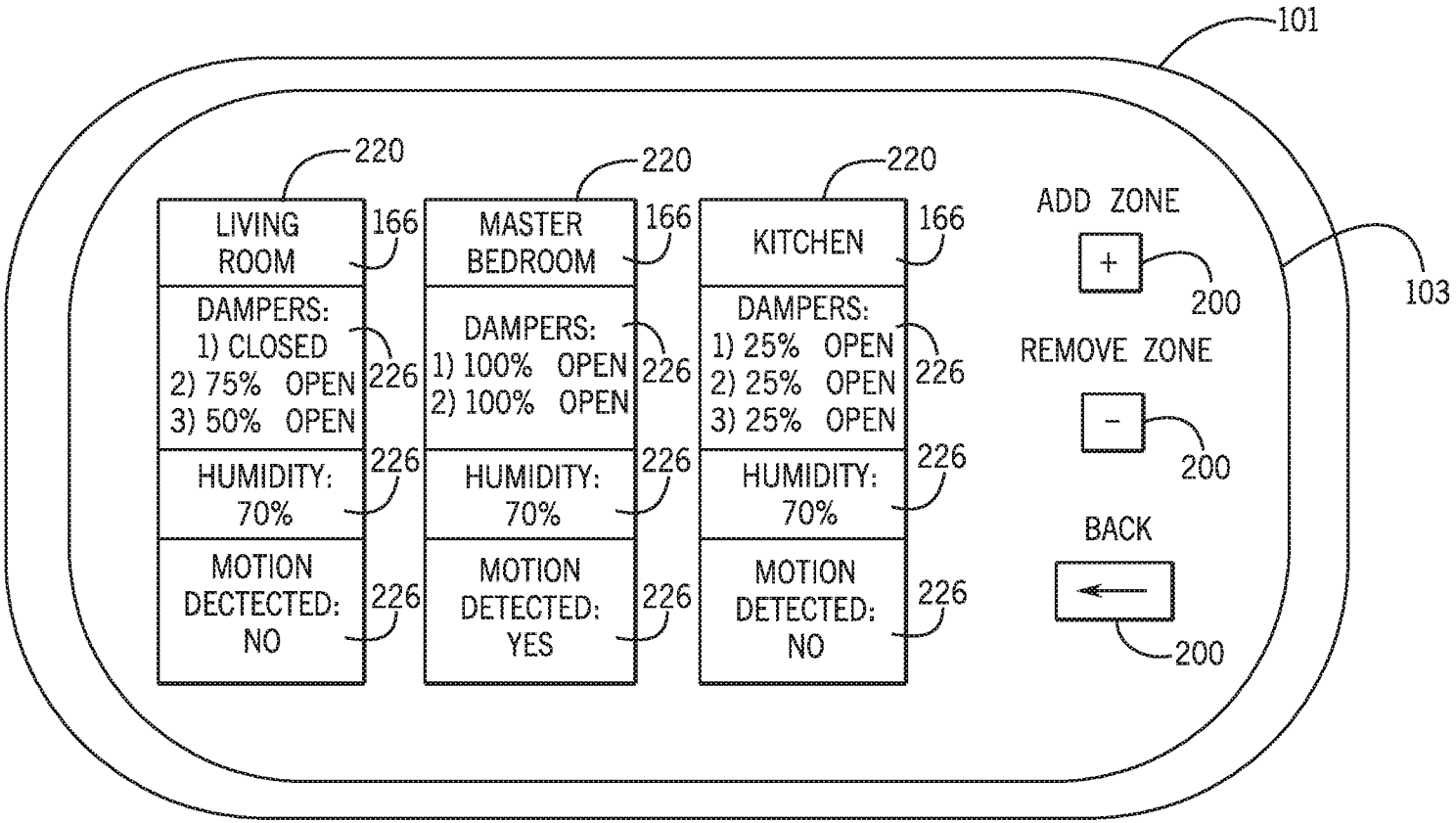
FIG. 14 illustrates an example of the zone control panel of FIG. 5 displaying another multi-zone screen, in accordance with an embodiment of the present disclosure.

As an illustrative example, FIG. 14 illustrates a view provided on the zone control panel electronic display 103 in response to the user selecting an on-screen icon 200. Accordingly, a user may view, for example, an overview of information related to one or more conditions in each of multiple zones, as illustrated in FIG. 13, and may then view more detailed and/or additional information related to each of the multiple zones, as illustrated in FIG. 14. The additional information may include, for example, an indication of damper positions, such as closed, 25% open, 50% open, 75% open, 100% open, and/or the like, for the HVAC equipment 116 corresponding to a zone. Additionally or alternatively, the additional information may include the measured humidity in a respective zone, whether motion has been detected (e.g., by a motion detector) in a respective zone, and/or the like.

In any case, a user, such as a technician, may rapidly compare multiple operation states 226 and/or conditions, such as temperature or humidity, present in a respective zone across a set of zones. Accordingly, the user may be provided with improved understanding of the operation of the HVAC system 102 as a whole. Further, a user may navigate and/or return to the information displayed in FIG. 13 simultaneously for each of the zones by selecting an on-screen icon 200 configured to go back to a previous view provided by the zone control panel electronic display 103 and/or by swiping and/or scrolling the zone control panel electronic display 103, as described above.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. A heating, ventilation, and air conditioning (HVAC) system comprising:

first equipment configured to facilitate supplying first temperature controlled air to a first internal space within a building serviced by the HVAC system, wherein the first equipment comprises a first zone thermostat having a first interface configured to display a first parameter of the first equipment or the first temperature controlled air;

second equipment separate from the first equipment and configured to facilitate supplying second temperature controlled air to a second internal space within the building serviced by the HVAC system, wherein the second equipment comprises a second zone thermostat separate from the first zone thermostat and having a second interface separate from the first interface, wherein the second interface is configured to display a second parameter of the second equipment or the second temperature controlled air; and a zone control panel separate from the first zone thermostat and the second zone thermostat, wherein the zone control panel is communicatively coupled to the first equipment and the second equipment and programmed to control operational aspects of the first equipment and the second equipment, wherein the zone control panel comprises:

an electronic display separate from the first interface and the second interface; and a microcontroller communicatively coupled to the electronic display, wherein the microcontroller is programmed to:

receive a user input entered to the zone control panel;

determine, based on the user input, a device targeted by the user input;

determine whether the device targeted by the user input belongs to the first equipment or the second equipment; and in response to determining that the device targeted by the user input belongs to the first equipment, instruct the electronic display of the zone control panel to reproduce aspects of the first interface of the first zone thermostat by displaying on the electronic display a graphical user interface illustrating the first parameter.

2. The HVAC system of claim 1, wherein the microcontroller is programmed to:

receive an additional user input entered via the zone control panel;

determine, based on the additional user input, an additional device targeted by the additional user input;

determine whether the additional device belongs to the first equipment or the second equipment; and in response to determining that the additional device belongs to the second equipment, instruct the electronic display of the zone control panel to reproduce aspects of the second interface of the second zone thermostat by displaying on the electronic display an additional graphical user interface illustrating the second parameter.

3. The HVAC system of claim 2, wherein:

the first equipment comprises an outdoor HVAC unit;

the second equipment comprises an indoor HVAC unit; and the microcontroller is programmed to:

instruct the electronic display to display a system overview screen comprising a first image of the outdoor HVAC unit and a second image of the indoor HVAC unit;

instruct the electronic display to display the graphical user interface in response to the user input selecting the first image of the outdoor HVAC unit in the system overview screen; and instruct the electronic display to display the additional graphical user interface in response to the additional user input selecting the second image of the indoor HVAC unit in the system overview screen.

4. The HVAC system of claim 1, wherein:

the first zone thermostat is configured to:

determine first measured air conditions within the first internal space or a corresponding first zone of the building; and output a first control signal requesting conditioning based at least in part on a first operational mode of the first zone thermostat and a difference between the first measured air conditions and first target air conditions associated with the first internal space or the corresponding first zone, wherein the microcontroller is programmed to instruct the electronic display to display a first zone settings screen that indicates the first measured air conditions within the first internal space or the corresponding first zone and the first operational mode of the first zone thermostat.

5. The HVAC system of claim 4, wherein:

the second zone thermostat is configured to:

determine second measured air conditions within the second internal space or a corresponding a second zone of the building; and output a second control signal requesting conditioning based at least in part on a second operational mode of the second zone thermostat and difference between the second measured air conditions and second target air conditions associated with the second internal space or the corresponding second zone, wherein the microcontroller is programmed to instruct the electronic display to display a second zone settings screen that indicates the second measured air conditions within the second internal space or the corresponding second zone and the second operational mode of the second zone thermostat.

6. The HVAC system of claim 5, wherein:

the first equipment comprises a first fan;

the first parameter comprises a first fan mode implemented by the first fan;

the second equipment comprises a second fan; and the second parameter comprises a second fan mode implemented by the second fan.

7. The system of claim 1, wherein the first parameter comprises a temperature or pressure parameter of the first temperature controlled air.

8. The system of claim 1, wherein the first parameter comprises an operational parameter of the first equipment, wherein the first interface of the first zone thermostat is configured to display the operational parameter and an airflow parameter of the first temperature controlled air, and wherein the microcontroller is programmed to instruct the electronic display of the zone control panel to reproduce aspects of the first interface of the first zone thermostat by displaying on the electronic display the graphical user interface illustrating the first operational parameter and the airflow parameter.

9. The system of claim 1, wherein:

the first zone thermostat is configured to output a first control signal requesting conditioning based at least in part on a first operational mode of the first zone thermostat and first target air conditions associated with the first internal space;

the second zone thermostat is configured to output a second control signal requesting conditioning based at least in part on a second operational mode of the second zone thermostat and second target air conditions associated with the second internal space; and the microcontroller is configured to instruct the electronic display to display:

a first zone settings screen that indicates the first operational mode of the first zone thermostat; and a second zone settings screen that indicates the second operational mode of the second zone thermostat.

10. A method for displaying information in a heating, ventilation, and air conditioning (HVAC) system on an electronic display of a zone control panel, comprising:

determining, using at least one processor of the zone control panel, a first device targeted by a user based at least in part on a first user input received by the zone control panel;

determining, using the at least one processor, whether the first device belongs to first equipment configured to facilitate supply of first temperature controlled air to a first internal space of a building serviced by the HVAC system or second equipment separate from the first equipment and configured to facilitate supply of second temperature controlled air to a second internal space of the building separate from the first internal space, the first equipment comprising a first zone thermostat separate from the zone control panel, corresponding to the first internal space, and having a first interface separate from the electronic display and configured to display a first parameter of the first equipment or the first temperature controlled air, and the second equipment comprising a second zone thermostat separate from the zone control panel and the first zone thermostat, corresponding to the second internal space, and having a second interface separate from the electronic display and the first interface, wherein the second interface is configured to display a second parameter of the second equipment or the second temperature controlled air; and in response to determining, via the at least one processor, that the first device targeted by the user belongs to the first equipment:

determining, using the at least one processor, first data indicative of the first parameter; and instructing, using the at least one processor, the electronic display to reproduce aspects of the first interface by displaying a first graphical user interface based at least in part on the first data indicative of the first parameter.

11. The method of claim 10, comprising:

determining, using the at least one processor, a second device targeted by the user based at least in part on a second user input received by the zone control panel; and in response to determining, via the at least one processor, that the second device targeted by the user belongs to the second equipment:

determining, using the at least one processor, second data indicative of the second parameter; and instructing, using the at least one processor, the electronic display to reproduce aspects of the second interface by displaying a second graphical user interface based at least in part on the second data indicative of the second parameter.

12. The method of claim 11, comprising:

instructing, using the at least one processor, the electronic display to display a system overview screen comprising a first image of the first equipment and a second image of the second equipment;

instructing, using the at least one processor, the electronic display to display the first graphical user interface in response to the first user input selecting the first image of the first equipment in the system overview screen; and instructing, using the at least one processor, the electronic display to display the second graphical user interface in response to the second user input selecting the second image of the second equipment in the system overview screen.

13. The method of claim 11, comprising, in response to the second user input being received while the electronic display displays the first graphical user interface:

instructing, using the at least one processor, the electronic display to display the first graphical user interface in a first portion of the electronic display; and instructing the electronic display to display the second graphical user interface in a second portion of the electronic display such that the electronic display simultaneously displays the first graphical user interface associated with the first equipment and the second graphical user interface associated with the second equipment.

14. The method of claim 10, comprising:

determining, using the first zone thermostat, first measured air conditions within the first internal space or a corresponding first zone of the building;

outputting, using the first zone thermostat, a first control signal requesting conditioning of the first internal space based at least in part on a first operational mode of the first zone thermostat and a difference between the first measured air conditions and first target air conditions associated with the first internal space or the corresponding first zone; and instructing, using the at least one processor, the electronic display to display a first zone settings screen that indicates the first measured air conditions within the first zone and the first operational mode of the first zone thermostat.

15. The method of claim 10, comprising:

outputting, via the first zone thermostat, a first control signal requesting conditioning based at least in part on a first operational mode of the first zone thermostat and first target air conditions associated with the first internal space;

outputting, via the second zone thermostat, a second control signal requesting conditioning based at least in part on a second operational mode of the second zone thermostat and second target air conditions associated with the second internal space;

instructing, via the at least one processor, the electronic display to display a first zone settings screen that indicates the first operational mode of the first zone thermostat; and instructing, via the at least one processor, the electronic display to display a second zone settings screen that indicates the second operational mode of the second zone thermostat.

16. The method of claim 10, comprising:

determining, via the first zone thermostat, first measured air conditions within the first internal space;

outputting, via the first zone thermostat, a first control signal requesting conditioning based at least in part on a first operational mode of the first zone thermostat and a first difference between the first measured air conditions and first target air conditions associated with the first internal space;

determining, via the second zone thermostat, second measured air conditions within the second internal space;

outputting, via the second zone thermostat, a second control signal requesting conditioning based at least in part on a second operational mode of the second zone thermostat and a second difference between the second measured air conditions and second target air conditions associated with the second internal space;

instructing, via the at least one processor, the electronic display to:

display a first zone settings screen that indicates the first measured air conditions within the first internal space and the first operational mode of the first zone thermostat; and display a second zone settings screen that indicates the second measured air conditions within the second internal space and the second operational mode of the second zone thermostat.

17. A tangible, non-transitory, computer-readable medium, comprising instructions executable by at least one processor of a zone control panel in a heating, ventilation, and air conditioning (HVAC) system that, when executed by the at least one processor, cause the at least one processor to:

determine a first device targeted by a first user input received by the zone control panel;

determine whether the first device belongs to first HVAC equipment configured to facilitate delivery of first temperature controlled air to a first internal space or second HVAC equipment separate from the first equipment and configured to facilitate delivery of second temperature controlled air to a second internal space, the first equipment comprising a first zone thermostat separate from the zone control panel and having a first interface configured to display a first parameter of the first equipment or the first temperature controlled air, and the second HVAC equipment comprising a second zone thermostat separate from the zone control panel, separate from the first zone thermostat, and having a second interface separate from the first interface, wherein the second interface is configured to display a second parameter of the second HVAC equipment or the second temperature controlled air; and in response to determining that the first device targeted by the first user input belongs to the first HVAC equipment:

determine first data indicative of the first parameter; and instruct an electronic display of the zone control panel to display a graphical user interface illustrating the first parameter based at least in part on the first data, wherein the electronic display is separate from the first interface and the second interface.

18. The computer-readable medium of claim 17, wherein the instructions, when executed by the at least one processor, cause the at least one processor to:

determine a second device targeted by a second user input received by the zone control panel;

determine whether the second device belongs to the first HVAC equipment or the second HVAC equipment; and in response to determining that the second device targeted by the second user input belongs to the second HVAC equipment:

determine second data indicative of the second parameter; and instruct the electronic display to display an additional graphical user interface illustrating the second parameter based at least in part on the second data.

19. The computer-readable medium of claim 17, wherein the instructions, when executed by the at least one processor, cause the at least one processor to:

instruct the electronic display to display a first zone settings screen that indicates a first operational mode corresponding to a first control signal of the first zone thermostat; and instruct the electronic display to display a second zone settings screen that indicates a second operational mode corresponding to a second control signal of the second zone thermostat.

20. The computer-readable medium of claim 17, wherein the instructions, when executed by the at least one processor, cause the at least one processor to:

instruct the electronic display to display a first zone settings screen that indicates first measured air conditions corresponding to the first internal space and a first operational mode corresponding to a first control signal of the first zone thermostat; and instruct the electronic display to display a second zone settings screen that indicates second measured air conditions corresponding to the second internal space and a second operational mode corresponding to a second control signal of the second zone thermostat.

* * * * *